US012338627B2

(12) United States Patent
Srinivasa et al.

(10) Patent No.: US 12,338,627 B2
(45) Date of Patent: Jun. 24, 2025

(54) ROOFING SHINGLES AND PALLETED PLURALITIES THEREOF

(71) Applicant: CERTAINTEED LLC, Malvern, PA (US)

(72) Inventors: Rakshith Srinivasa, San Diego, CA (US); Paul A. Benensky, Collegeville, PA (US); Stephen A. Koch, Collegeville, PA (US)

(73) Assignee: CERTAINTEED LLC, Malvern, PA (US)

( * ) Notice: Subject to any disclaimer, the term of this patent is extended or adjusted under 35 U.S.C. 154(b) by 749 days.

(21) Appl. No.: 17/300,934

(22) Filed: Dec. 15, 2021

(65) Prior Publication Data

US 2022/0186499 A1 Jun. 16, 2022

Related U.S. Application Data

(60) Provisional application No. 63/125,895, filed on Dec. 15, 2020, provisional application No. 63/125,897, filed on Dec. 15, 2020.

(51) Int. Cl.

| | |
|---|---|
| ***E04D 1/28*** | (2006.01) |
| ***B65D 71/00*** | (2006.01) |
| ***E04D 1/20*** | (2006.01) |
| ***E04D 1/26*** | (2006.01) |
| *E04D 1/00* | (2006.01) |

(52) U.S. Cl.

CPC ..... *E04D 1/28* (2013.01); *B65D 71/0088* (2013.01); *E04D 1/20* (2013.01); *E04D 1/26* (2013.01); *E04D 2001/005* (2013.01)

(58) Field of Classification Search

CPC .... E04D 1/28; E04D 1/20; E04D 1/26; E04D 2001/005; B65D 71/0088; B65D 71/0096; B65D 19/0093; B65D 19/0095

See application file for complete search history.

(56) References Cited

U.S. PATENT DOCUMENTS

| | | | | |
|---|---|---|---|---|
| 5,571,596 | A * | 11/1996 | Johnson | B32B 5/26 428/338 |
| 6,145,265 | A * | 11/2000 | Malarkey | E04D 1/26 52/745.19 |
| 6,709,994 | B2 * | 3/2004 | Miller | D06N 5/00 442/364 |
| 6,715,252 | B2 | 4/2004 | Stahl et al. | |
| 7,811,630 | B2 | 10/2010 | Hong et al. | |
| 8,006,457 | B2 | 8/2011 | Binkley et al. | |
| 8,240,100 | B2 | 8/2012 | Kalkanoglu et al. | |
| 8,316,608 | B2 | 11/2012 | Binkley et al. | |
| 8,420,172 | B1 * | 4/2013 | Loper | E04D 1/20 427/289 |

(Continued)

FOREIGN PATENT DOCUMENTS

| | | | | |
|---|---|---|---|---|
| GB | 2498446 | A * | 7/2013 | B65D 5/5035 |

OTHER PUBLICATIONS

Green, David W. et al., "Mechanical Properties of Wood," Forest Products Laboratory, Chapter 4, dated 1999, pp. 4-1 through 4-45.

*Primary Examiner* — Adriana Figueroa

(74) *Attorney, Agent, or Firm* — Abel Schillinger, LLP; Stephen Eland

(57) ABSTRACT

The present disclosure relates to roofing shingles and palleted pluralities thereof that have a reduced susceptibility to damage during shipment.

20 Claims, 10 Drawing Sheets

(56) References Cited

U.S. PATENT DOCUMENTS

| | | | | |
|---|---|---|---|---|
| 8,668,954 | B2 | 3/2014 | Hong et al. | |
| 8,722,140 | B2 | 5/2014 | Shiao et al. | |
| 8,984,835 | B2 | 3/2015 | Kalkanoglu et al. | |
| 9,404,263 | B2 * | 8/2016 | Kiik | E04D 1/26 |
| 9,422,719 | B2 | 8/2016 | Shiao et al. | |
| 9,845,602 | B2 * | 12/2017 | Kiik | B32B 5/022 |
| 10,094,115 | B2 | 10/2018 | Shiao et al. | |
| 10,174,504 | B1 | 1/2019 | Freiborg | |
| 10,180,002 | B2 | 1/2019 | Freiborg | |
| 10,180,003 | B2 | 1/2019 | Freiborg | |
| 10,947,729 | B2 * | 3/2021 | Collins | B32B 7/12 |
| 2004/0104138 | A1 * | 6/2004 | Remaks | B65D 71/70 206/499 |
| 2005/0238848 | A1 * | 10/2005 | Fensel | B32B 11/10 428/143 |
| 2010/0055399 | A1 | 3/2010 | Rosko et al. | |
| 2011/0094979 | A1 * | 4/2011 | Lowery | B65D 71/0096 108/51.11 |
| 2013/0026061 | A1 * | 1/2013 | Lehn | B65D 85/34 206/597 |
| 2017/0284100 | A1 | 10/2017 | Jenkins et al. | |
| 2018/0186694 | A1 | 7/2018 | Lante et al. | |
| 2018/0194684 | A1 | 7/2018 | Panzarella et al. | |
| 2019/0300449 | A1 | 10/2019 | Panzarella et al. | |
| 2019/0323240 | A1 | 10/2019 | Gomes et al. | |

* cited by examiner

ROOFING SHINGLES AND PALLETED PLURALITIES THEREOF

CROSS-REFERENCE TO RELATED APPLICATIONS

This application claims the benefit of priority of U.S. Provisional Patent Applications Nos. 63/125,895 and 63/125,897, each filed Dec. 15, 2020, each of which is hereby incorporated herein by reference in its entirety.

BACKGROUND OF THE DISCLOSURE

1. Field of the Disclosure

The present disclosure relates to roofing shingles, for example, bituminous roofing shingles suitable for covering and protecting the roofs of houses, buildings, and other structures.

2. Technical Background

Roofing shingles, such as asphalt shingles, are applied in courses over a roof to protect the roof structure from weather, particularly water. Most roofing shingles are secured to an underlying structure using nails. Typically, the roofing shingles are designed to have a designated area, a so-called "nailing zone," where the nails penetrate through the shingle to the underlying structure. In typical circumstances, nails that extend through the designated nail zone and to a sufficient depth in the roof structure will provide a secure and watertight roof.

Roofing shingles are typically based on bituminous materials, disposed on both sides of a substrate such as a fiberglass mesh or a felt material. The bituminous materials are typically coated with roofing granules in order to provide a less sticky surface and in order to protect the bituminous material from solar radiation.

In order to provide improved impact resistance to a roofing shingle, it is common to use a polymer-modified asphalt as the bituminous material. Modification with an elastomer such as a styrene-butadiene-styrene rubber is one common method to improve impact resistance.

However, the present inventors have noted that a drawback to some such materials is that shingles using them can suffer from deformation or sticking when stacked on a pallet and shipped. Accordingly, the present inventors have noted that, while it is common to provide a double "stack" of palleted asphalt shingles (i.e., one loaded pallet on top of another) for shipping, it is often necessary to limit palleted impact-resistant shingles to only a single stack (i.e., without stacking pallets on top of one another). This undesirable increases shipping costs.

Accordingly, the present inventors have determined that there is a need for improvements in roofing shingles and packaging thereof, especially with respect to impact-resistant roofing shingles.

SUMMARY OF THE DISCLOSURE

The present inventors have determined a number of ways to reduce the problem of sticking and deformation when bituminous roofing shingles are stacked and shipped, especially for impact-resistant shingles. For example, the present inventors have determined that using small particulate material as a top surfacing in a zone where an overlay sheet overlaps an underlay sheet can help reducing so-called "humping" in that zone by providing a relatively lower apparent thickness of the overlay sheet in that zone of overlap as compared to a neighboring zone. Reducing humping in turn can help reduce buildup of pressure on such humps, thereby reducing the amount of sticking and deformation. The present inventors have also found that the mass of the shingle can be advantageously reduced, for example, by providing a relatively low weight of asphalt material in the bottom asphalt layer of each sheet, without a detriment in shingle performance. Reduced weight can advantageously cause less pressure to build through the stack. The present inventors have also found that the structure of the pallet on which the roofing shingles are stacked can be designed to help reduce sticking and deformation of stacked shingles, for example by providing a reduced amount of space between boards forming the top surface of the pallet, by having the plurality of top boards take up a high fraction of the occluded area of the top surface of the pallet and/or by providing relatively thick boards as the boards forming the top surface of the pallet. These can provide better and more support for the shingles, and thus cause less hotspots of high pressure and thus reduce deformation and sticking. These advances can be used singly and multiply in any combination.

Thus, in one aspect the disclosure provides a roofing shingle having an upper edge, a lower edge, a first end, and a second end, the roofing shingle comprising:

- a headlap section extending from the upper edge of the shingle toward the lower edge;
- an exposure section below the headlap section and extending from a lower edge of the headlap section to the lower edge of the shingle; and
- a nailing zone extending across the roofing shingle from the first end to the second end within the headlap section, the roofing shingle being formed of

- an overlay sheet having a top surface and a bottom surface; and
- an underlay sheet having a top surface and a bottom surface,
- each of the overlay sheet and the underlay sheet comprising
  - a substrate,
  - a top asphalt layer extending from a top surface of the substrate and being surfaced with one or more top surfacings, and
  - a bottom asphalt layer extending from a bottom surface of the substrate and being surfaced with one or more bottom surfacings,
- the overlay layer overlapping the underlay sheet along an overlap zone extending from the first end to the second end of the roofing shingle in or adjacent the nailing zone, with the top surface of the underlay sheet being affixed to the bottom surface of the overlay sheet in the overlap zone,
- the top surfacings of any exposed area of the overlap sheet and the underlay sheet in the exposure zone being roofing granules;

wherein

- (a) a bottom portion of each of the overlay sheet and the underlay sheet comprising the bottom asphalt layer and the one or more bottom surfacings has a weight of no more than 11 pounds per 100 square feet, and/or
- (b) the shingle has at its top surface a small particulate zone defined by a top surfacing of a small particulate material extending from the first end to the second end of the roofing shingle, the small particulate material having a d50 particle size of no more than half a d50 particle size of roofing granules disposed as a top surfacing in a lower adjacent zone to the small particulate zone, the small particulate zone being at least one inch in height as measured in a direction from the upper edge to the lower edge of the shingle, the small particulate zone at least partially overlapping the overlap zone.

In another aspect, the disclosure provides a roofing system comprising:

a roof structure;

a first roofing shingle according to the disclosure disposed on the roof structure;

a first mechanical fastener securing the first roofing shingle to the roof structure, wherein the first mechanical fastener is disposed within the nailing zone and passes through the overlay sheet.

In another aspect, the disclosure provides a method of installing a roofing system according to the disclosure, the method comprising:

positioning a first roofing shingle according to the disclosure on a roof structure;

driving a first mechanical fastener through the nailing zone of the first roofing shingle and into the roof structure so as to secure the first roofing shingle to the roof structure, wherein the first mechanical fastener passes through the overlay sheet.

In another aspect, the disclosure provides a palleted plurality of roofing shingles comprising a plurality of roofing shingles disposed in one or more stacks on a pallet, wherein the pallet has a top surface formed of a plurality of top boards, and wherein (a) adjacent boards of the plurality of top boards have a gap of no more than one inch therebetween at the top surfaces thereof; and/or (b) the plurality of top boards take up at least 85% of the occluded area of the top surface of the pallet;

(c) each of the plurality of top boards has a thickness of at least 0.55 inches, and wherein each roofing shingle has an upper edge, a lower edge, a first end, and a second end, each roofing shingle comprising:

a headlap section extending from the upper edge of the shingle toward the lower edge;

an exposure section below the headlap section and extending from a lower edge of the headlap section to the lower edge of the shingle; and a nailing zone extending across the roofing shingle from the first end to the second end within the headlap section, the roofing shingle being formed of an overlay sheet having a top surface and a bottom surface; and an underlay sheet having a top surface and a bottom surface, each of the overlay sheet and the underlay sheet comprising a substrate, a top asphalt layer extending from a top surface of the substrate and being surfaced with one or more top surfacings, and a bottom asphalt layer extending from a bottom surface of the substrate and being surfaced with one or more bottom surfacings, the overlay layer overlapping the underlay sheet along an overlap zone extending from the first end to the second end of the roofing shingle in or adjacent the nailing zone, with the top surface of the underlay sheet being affixed to the bottom surface of the overlay sheet in the overlap zone, the top surfacings of any exposed area of the overlap sheet and the underlay sheet in the exposure zone being roofing granules, optionally wherein (a) the bottom portion of each of the overlay sheet and the underlay sheet comprising the bottom asphalt layer and the one or more bottom surfacings has a weight of no more than 11 pounds per 100 square feet, and/or (b) the shingle has at its top surface a small particulate zone defined by a top surfacing of a small particulate material extending from the first end to the second end of the roofing shingle, the small particulate material having a d50 particle size of no more than half a d50 particle size of roofing granules disposed as a top surfacing in a lower adjacent zone to the small particulate zone, the small particulate zone being at least one inch in height as measured in a direction from the upper edge to the lower edge of the shingle, the small particulate zone at least partially overlapping the overlap zone.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that bituminous shingles, and especially impact-resistant shingles, e.g., based on elastomer-modified asphalt materials, can suffer from problems with sticking and deformation when they are stacked onto pallets and shipped. The present inventors have noted a number of advances, both in shingle design and in pallet design, that can be used singly or in any combination to improve the problems with sticking and deformation.

Figure 1:
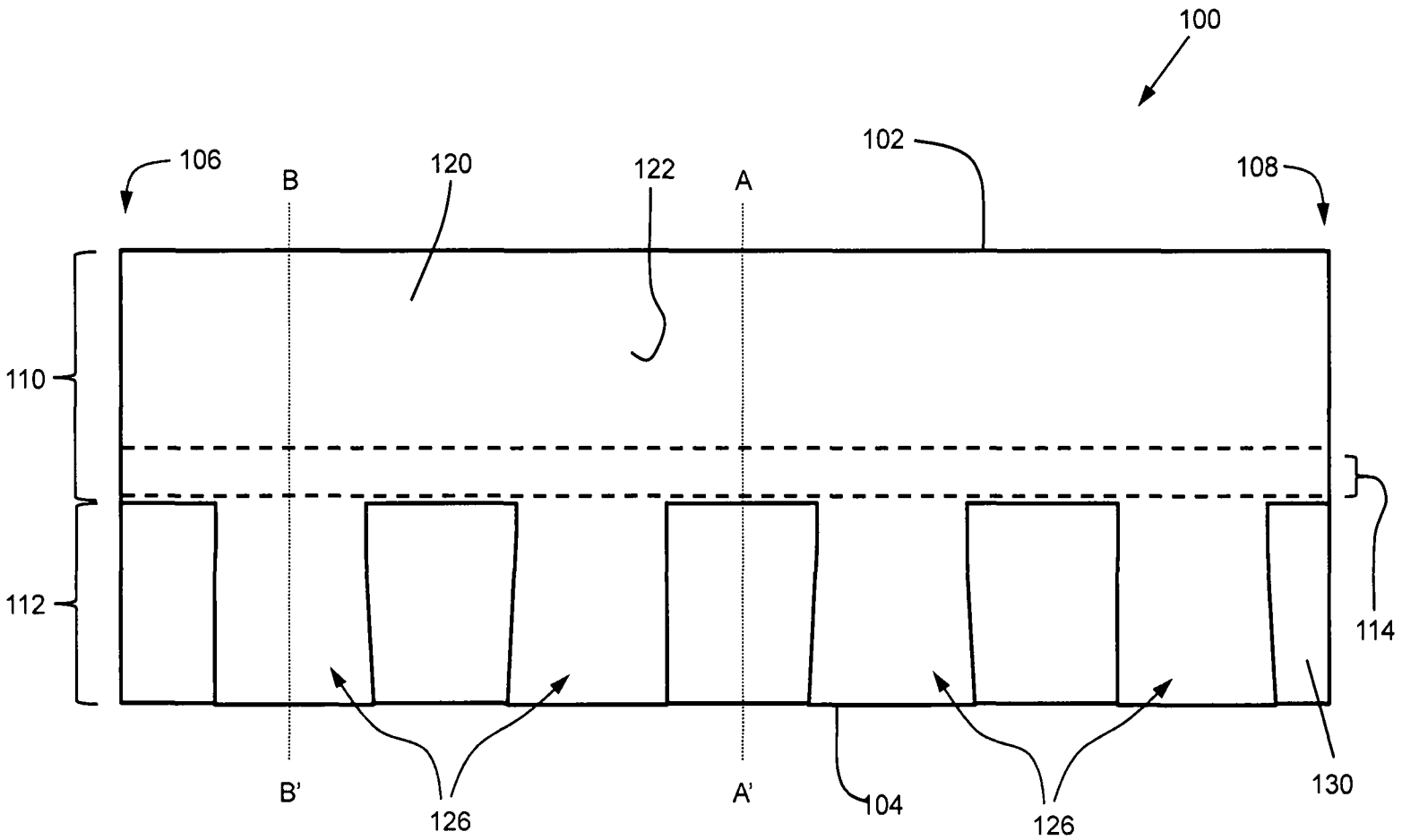
FIG. 1 is a schematic top view of a roofing shingle according to an embodiment of the disclosure.

Accordingly, one embodiment of the disclosure is shown in top view in schematic top view in FIG. 1. Roofing shingle 100 includes an upper edge 102, a lower edge 104, a first end 106 and a second end 108. Further, roofing shingle 100 has a headlap section 110 extending from the upper edge of the shingle toward the lower edge; and an exposure section 112 below headlap section 110, extending from a lower edge of the headlap section to the lower edge of the shingle. As is conventional, upon installation the headlap section 110 may be covered by one or more additional roofing shingles that are part of overlying course of shingles disposed on top of roofing shingle 100, while the exposure zone 112 remains exposed. A nailing zone 114 extends through headlap section 110 across the width of roofing shingle 100 from first end 106 to second end 108. Nailing zone 114 extends across the roofing shingle from the first end to the second end within the headlap section. As is conventional, the nailing zone is a portion of the roofing shingle that is suitable for receiving nails or other mechanical fasteners for securing roofing shingle 100 to an underlying roof structure. In some embodiments, the nailing zone runs continuously from one end of the roofing shingle to the other, such as nail zone 114. In other embodiments, the nailing zone is formed by intermittent sections where fasteners are intended to be placed.

Figure 2:
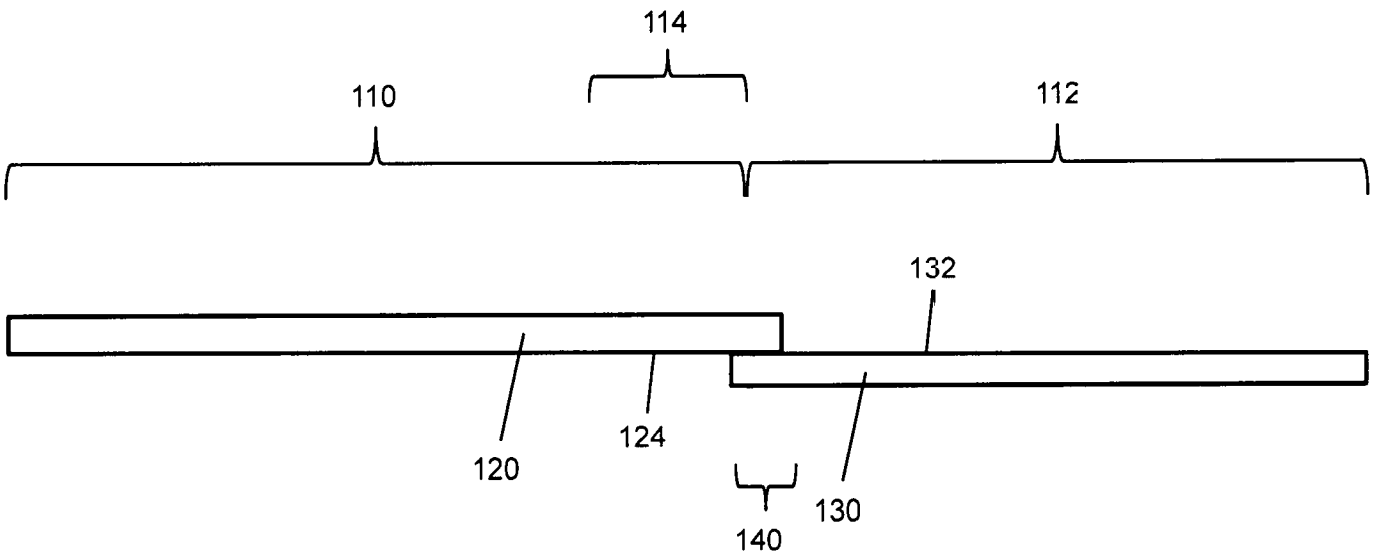
FIG. 2 is a schematic cross-sectional view of the roofing shingle of FIG. 1 along line A-A'.

Roofing shingles as described herein are formed of an overlay sheet having a top surface and a bottom surface, and an underlay sheet having a top surface and a bottom surface. The overlay sheet overlaps the underlay sheet along an overlap zone extending from the first end to the second end of the roofing shingle, in or adjacent the nailing zone. The top surface of the underlay sheet is affixed to the bottom surface of the overlay sheet in the overlap zone. FIG. 2 is a cross-sectional view of roofing shingle 100 of FIG. 1, along the line A-A'. Here, overlay sheet 120 has a top surface and a bottom surface 124, and underlay sheet 130 has a top surface 132 and a bottom surface. The overlay sheet 120 overlaps underlay sheet 130 in an overlap zone 140. This overlap zone extends from the first end to the second end of the roofing shingle, in or adjacent to the nailing zone. In the embodiment of FIGS. 1 and 2, the overlap zone is partially in the nailing zone and partially outside of the nailing zone. The top surface 132 of the underlay sheet 130 is affixed to the bottom surface 124 of the overlay sheet in the overlap zone. The sheets can be affixed to one another in a variety of ways. For example, in certain embodiments an adhesive secures the top surface of the underlay sheet to the bottom surface of the overlay sheet. In other embodiments the sheets are attached to one another by another method, such as using a molten material, using mechanical fasteners, or deforming the layers of the shingle together, such as a stitching process. Various methods of securing sheets of a multilayer shingle together are described, for example, in U.S. Pat. Nos. 8,006,457, 8,316,608, 8,240,100, and 8,984,835.

Figure 3:
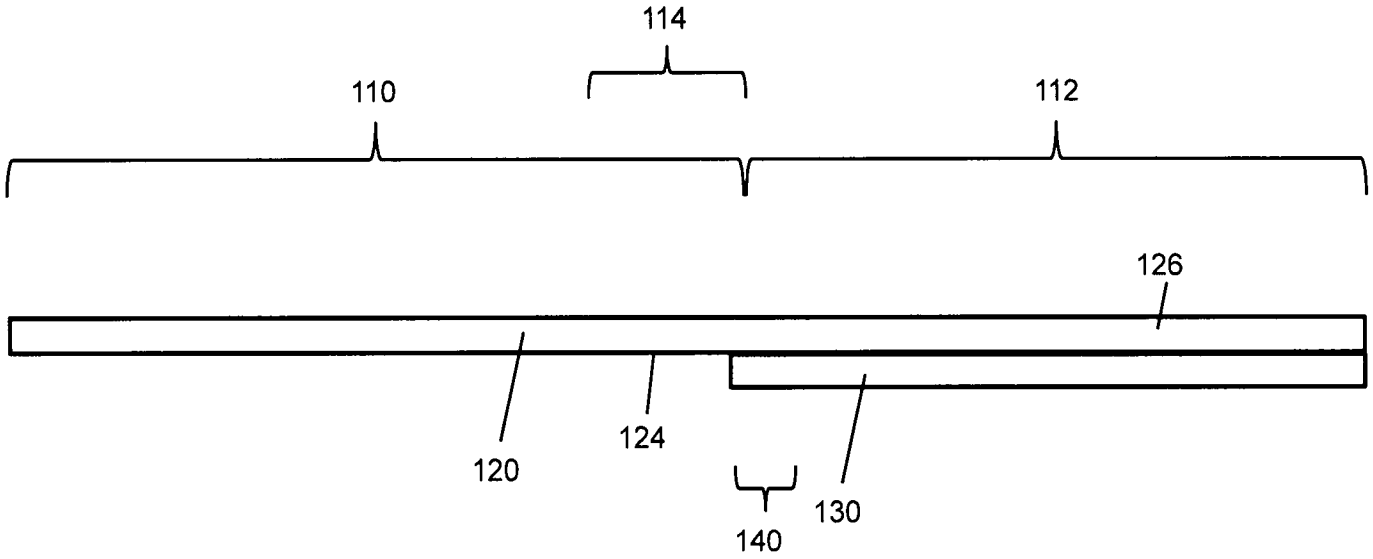
FIG. 3 is a schematic cross-sectional view of the roofing shingle of FIG. 1 along line B-B'.

In certain embodiments, the overlay sheet includes one or more tabs that are disposed on the underlay sheet and extend toward the lower edge of the shingle. This is shown in the schematic view of FIG. 1. Here, overlay sheet 120 includes tabs—here, so-called "dragon's teeth" 126—disposed on the underlay sheet 130 and extending toward the lower edge 104 of the shingle. FIG. 3 is a schematic cross-sectional view of roofing shingle 100 of FIG. 1, along the line B-B'. Here, tab 126 extends beyond the overlap zone and onto the underlay sheet 130. Various different geometric configurations of the tabs of the top shingle and the sheet layer are possible. Examples of such configurations are described, for example, in U.S. Pat. Nos. 6,715,252, 10,180,002, 10,180,003, 10,174,504, and U.S. Patent Publication No. 2017/0284100.

Each of the overlay sheet and the underlay sheet can be provided in conventional manners in the bituminous roofing art. For example, in various embodiments as otherwise described herein, each of the overlay sheet and underlay sheet includes a substrate, a top asphalt layer extending from a top surface of the substrate and being surfaced with one or more top surfacings, and a bottom asphalt layer extending from a bottom surface of the substrate and being surfaced with one or more bottom surfacings. A variety of substrates can be used. For example, in certain embodiments the substrate is a fibrous mat, for example, formed from woven or non-woven glass fibers, polymeric fibers, or a combination of glass and polymeric fibers, e.g., a fiberglass sheet or a roofing felt. The top and bottom asphalt layers can be made from the same material as one another, or from different materials. Asphalt materials used in bituminous shingles are well-known in the art. A conventional material is formed from a mixture of an asphalt (e.g., oxidized asphalt) and a filler (e.g., particulate limestone). The amount of filler can range, in some examples, from 40-70 wt % of the overall asphalt material. Particular asphalt materials useful in certain embodiments of the disclosure are described in more detail below. Asphalt material (e.g., the same as the material of the top asphalt layer and/or the material of the bottom asphalt layer) can penetrate into the substrate, e.g., into interstices within fibers of a fibrous substrate. In many examples, a single asphalt material is disposed throughout the substrate and forms the top and bottom layers of asphalt. One example of such a sheet is shown in partial schematic cross-sectional view in FIG. 4. Here, the sheet 420 includes a substrate 422 (e.g., a fiberglass mesh), a top asphalt layer 424 extending from a top surface of the substrate, and a bottom asphalt later 426 extending from a bottom surface of the substrate. In this embodiment, the substrate is impregnated with asphalt from the top asphalt layer.

As is conventional, each of the overlay sheet and the underlay sheet is surfaced with one or more surfacings. Such surfacings are well-known in the art, and typically take the form of particulate materials that are embedded in the softened asphalt materials while they are still warm. Surfacings typically help keep the asphalt materials from sticking as they warm up on a roof. Moreover, surfacings in the exposure zone of a shingle can protect the asphalt material of the top asphalt layer from being degraded by sunlight.

Top layer surfacings that are exposed in the exposure zone of a shingle are typically formed of roofing granules. Roofing granules can provide color to the exposed top surface of the roofing shingle in addition to protecting the asphalt material. For example, in some embodiments the roofing granules are highly reflective to reduce the temperature of the roofing shingles. In other embodiments, the roofing granules include algae resistance to prevent growth on the roofing shingles. The roofing granules can have a range of different material constructions, as will be appreciated by those of ordinary skill in the art. In some embodiments, the roofing granules include a base particle having at least one coating layer disposed thereon. In some embodiments, the base particles include chemically inert materials, such as inert mineral particles, solid or hollow glass or ceramic spheres, or foamed glass or ceramic particles. In some embodiments the base particles are inert mineral particles that are produced by a series of quarrying, crushing, and screening operations, and are generally intermediate between sand and gravel in size (that is, between about #8 US mesh and #70 US mesh). In some embodiments, the base particles have an average particle size of from about 0.1 mm to about 5 mm, e.g., from about 0.2 mm to 2.5 mm, e.g., from about 0.4 mm to about 2.4 mm. Further, in some embodiments, the base particles of the roofing granules include naturally occurring materials such as talc, slag, granite, silica sand, greenstone, andesite, porphyry, marble, syenite, rhyolite, diabase, greystone, quartz, slate, trap rock, basalt, and marine shells, as well as recycled manufactured materials such as crushed bricks, concrete, porcelain, fire clay, and the like. Crushed slate particles can also be used to form granules of a more or less flat morphology. In some embodiments the granules are synthetic granules, having synthetic base materials, such as those made of clays or other preceramic materials. In some embodiments the base particles of the roofing granules are formed as solid or hollow glass spheres in a similar range of sizes. In some embodiments, the glass spheres are coated with a suitable coupling agent to provide improved adhesion to a binder included in a coating that surrounds the base particle. Applicable synthetic roofing granules and methods of manufacturing them are described in U.S. Pat. Nos. 7,811,630, 8,668,954, 8,722,140, 9,422,719, 10,094,115, U.S. Patent Publication No. 2018/0186694, U.S. Patent Publication No. 2018/0194684, U.S. Patent Publication No. 2019/0300449, and U.S. Patent Publication No. 2019/0323240. As will be understood by those of ordinary skill in the art, the color of the roofing granules may be imparted, for example, by coloring pigments that are included in the granules, such as in a binder of a coating on the base particle. Such pigments may include suitable metal oxides.

Top layer surfacings that are not exposed in an exposure zone of a shingle, e.g., in the headlap zone and surfacings of an underlay sheet that are covered by an overlay sheet, can be provided by a variety of particulate materials. For manufacturing efficiency, it may be desirable to simply surface these top surface regions with the same roofing granules as in the exposure zone. But other, cheaper granules may be used. These can be, e.g., so-called "granule fines," i.e., small particulate waste from the manufacture of conventional granules, or can be uncoated versions of the granules described above (e.g., just the base particles described above). Sand can also be used, as can other particulate materials such as mica flakes, copper slag, coal slag, sand, talc, expanded clay, slate flour, powdered limestone and silica dust. Any combination can be used. Bottom layer surfacings are typically the same as described above with respect to the cheaper materials for use in unexposed areas.

Figure 4:
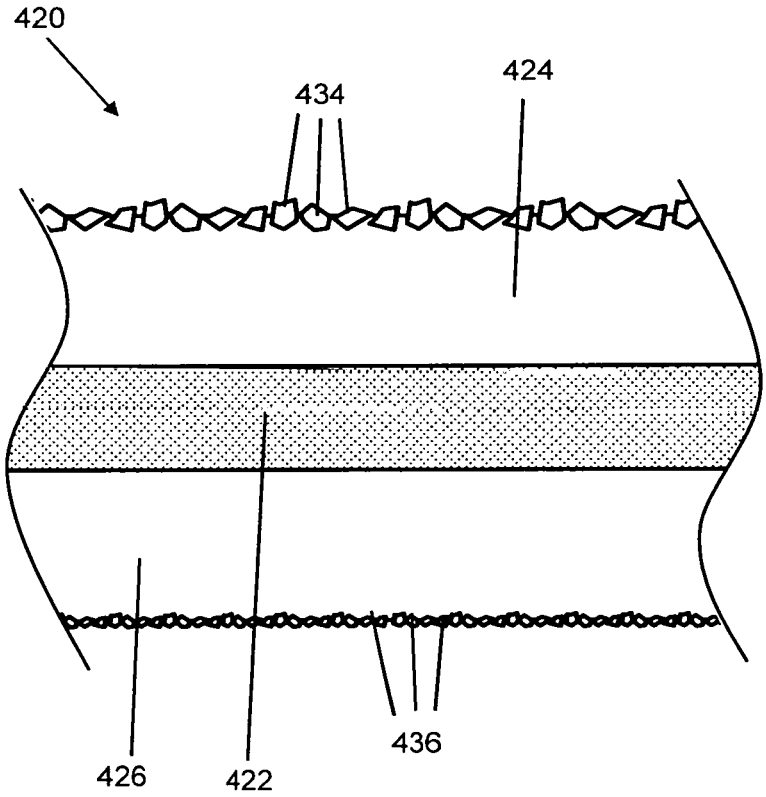
FIG. 4 is a partial schematic cross-sectional view of a sheet useful as part of a roofing shingle as described herein.

In the embodiment of FIG. 4, the surfacing of the top asphalt layer 424 is roofing granules 434; and the surfacing of the bottom asphalt layer is sand 436.

As noted above, the present inventors have made a number advances in addressing the problem of roofing single and deformation, especially with respect to impact-resistant roofing shingles as described below. These advances can be used singly and multiply in any combination.

For example, in certain embodiments as otherwise described herein, a bottom portion of each of the overlay sheet and the underlay sheet comprising the bottom asphalt layer and the one or more bottom surfacings has a weight of no more than 11 pounds per 100 square feet. The weight of the bottom portion can be determined by physically scraping the asphalt layer and the bottom surfacing(s) from an area of the substrate of a sheet, then weighing the scraped material and dividing by area and normalizing to 100 square feet. The present inventors have found that acceptable shingle quality can be provided even when lower weights of materials, especially of asphalt material, are used in the bottom portions of the sheets. This is true even when the asphalt material is an impact-resistant elastomer-modified asphalt material. In certain embodiments as otherwise described herein, the bottom portion of each of the overlay sheet and the underlay sheet comprising the bottom asphalt layer and the one or more bottom surfacings has a weight of no more than 10.7 pounds per 100 square feet, e.g., no more than 10.5 pounds per 100 square feet. For example, in various embodiments as otherwise described herein, the weight of the bottom portion of each of the overlay sheet and the underlay sheet is in the range of 9-11 pounds per 100 square feet, e.g., in the range of 9-10.7 pounds per 100 square feet, or 9-10.5 pounds per 100 square feet, or 9.5-11 pounds per 100 square feet, or 9.5-10.7 pounds per 100 square feet, or 9-10.5 pounds per 100 square feet. In other embodiments as otherwise described herein, the weight of the bottom portion of each of the overlay sheet and the underlay sheet is in the range of 10-11 pounds per 100 square feet, e.g., in the range of 10-10.7 pounds per 100 square feet, or 10-10.5 pounds per 100 square feet, or 10.3-11 pounds per 100 square feet, or 10.3-10.7 pounds per 100 square feet, or 10.3-10.5 pounds per 100 square feet.

In certain embodiments as otherwise described herein (e.g., in combination with the reduced weights described above, or independently of asphalt coating weight), the shingle has at its top surface a small particulate zone defined by a top surfacing of a small particulate material extending from the first end to the second end of the roofing shingle, the small particulate material having a d50 particle size of no more than half a d50 particle size of roofing granules disposed as a top surfacing in a lower adjacent zone to the small particulate zone, the small particulate zone being at least one inch in height as measured in a direction from the upper edge to the lower edge of the shingle, the small particulate zone at least partially overlapping the overlap zone (i.e., of the overlay sheet and the underlay sheet).

The present inventors have noted that a particular point of failure of shingles during shipment and storage is in the region of the overlap zone. Without intending to be bound by theory, the inventors note the overlap of the two layers can cause a hump in the shingle, which can be especially notable in regions where there is a relatively narrow hump, e.g., in the overlap region described with respect to FIG. 2 above. Such a narrow hump can result in a relatively high local pressure from overlying shingles in a packaged stack. In contrast, local pressure buildup can be substantially less in regions where a tab is provided, as described with respect to FIG. 3, as there is more surface area to support overlying shingles in the stack. In certain embodiments as otherwise described herein, the roofing shingle includes one or more areas where the overlay sheet is disposed on the underlay sheet with a degree of overlap of no more than 1.5 inches, e.g., no more than 1 inch, for example, in the range of 0.3-1.5 inches, or 0.3-1 inch, or 0.5-1.5 inches, or 0.5-1 inch, or 0.75-1.5 inches. The overlap of the sheets at the line A-A' of FIG. 1, as shown in FIG. 2, has such a geometry, while the overlap of the sheets at the line B-B' does not.

The present inventors have found that use of a small particulate material overlapping at least part of the overlap zone can lower the apparent thickness of the shingle in the overlap zone, and thus can reduce the apparent hump in the packaged shingles.

Figure 5:
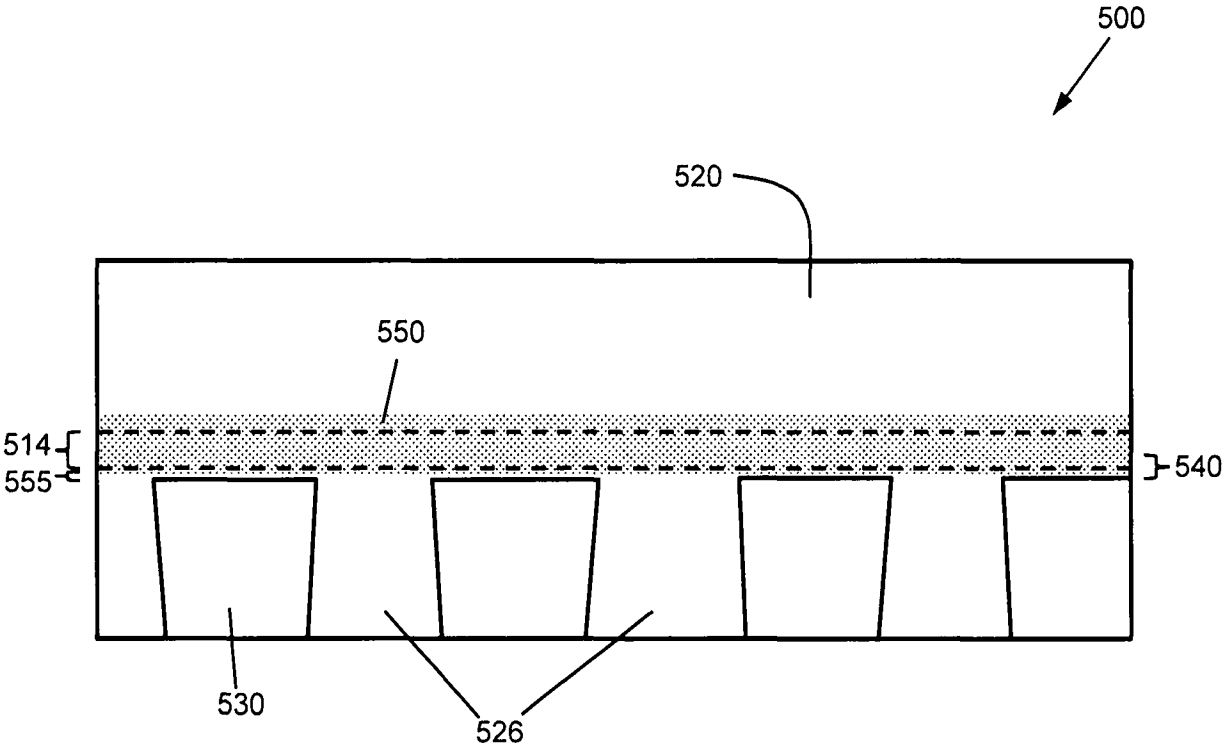
FIG. 5 is a schematic top view of a roofing shingle according to another embodiment of the disclosure.

One embodiment of such a roofing shingle is shown in schematic top view in FIG. 5. Here, roofing shingle 500 includes an overlay sheet 520 and an underlay sheet 530, with tabs 526 of the overlay sheet extending toward the lower edge of the shingle on top of the underlay sheet, substantially as described above. The overlap zone 540 is defined by the minimum extent of overlap of the overlay and underlay sheets across the shingle. This shingle has at its top surface, here, on the top surface of the overlay sheet, a small particulate zone 550 defined by a top surfacing of a small particulate material extending from the first end to the second end of the roofing shingle. The small particulate material has a d50 particle size of no more than half a d50 particle size of roofing granules disposed as a top surfacing in a lower adjacent zone to the small particulate zone. The lower adjacent zone is the granule-coated surface that borders the small particulate zone toward the lower edge of the roofing shingle—here, indicated by reference number 555. The small particulate zone is at least one inch in height as measured in a direction from the upper edge to the lower edge of the shingle. Notably, the small particulate zone 550 at least partially overlaps the overlap zone 540; here, the overlap is partial, but not complete; the small particulate zone does not extend into the portion 555 of the overlap zone 540. However, in other embodiments contemplated herein, the small particulate zone completely overlaps the overlap zone.

As used herein, the d50 particle size is the median particle size, i.e., the size of the particle at which 50% of the particles are of larger particle size and 50% are of smaller particle size. As used herein, "particle size" is the largest dimension of the particle.

The person of ordinary skill in the art will appreciate that a variety of materials can be used as the small particulate material. For example, in certain desirable embodiments as otherwise described herein, the small particulate material is sand. In various embodiments as otherwise described herein, the small particulate material is mica flakes, copper slag, coal slag, sand, talc, expanded clay, slate flour, powdered limestone or silica dust. Of course, a variety of other materials, such as those described above with respect to the roofing granules and base particles therefor, can be used at the small particulate material when provided at an appropriate particle size.

The small particulate material can advantageously be provided in a variety of particle sizes with respect to the roofing granules disposed as a top surfacing in a lower adjacent zone to the small particulate zone. For example, in certain embodiments as otherwise described herein, the small particulate material having a d50 particle size of no more than ⅓ of (e.g., no more than ¼ of, or no more than ⅕ of) a d50 particle size of roofing granules disposed as a top surfacing in a lower adjacent zone to the small particulate zone. By providing a larger difference between the particle sizes, more of a "hump" formed by the overlapping sheets can be compensated for. In various embodiments, the d50 particle size of the small particulate material is in the range of 1/10-½ of the d50 particle size of roofing granules disposed as a top surfacing in a lower adjacent zone to the small particulate zone, e.g., 1/10-⅓, or 1/10-¼, or 1/10-⅕, or ⅛-⅓, or ⅛-¼, or ⅛-⅕, or ⅙-⅓, or ⅙-¼.

The d95 particle size can also be important, as if there are too many large particles in the small particulate material, they can undesirably raise the apparent top surface in the small particulate zone. Accordingly, in certain embodiments as otherwise described herein, the small particulate material has a d95 particle size of no more than ½ of (e.g., no more than ¼ of, or no more than % of, or no more than ⅕ of) a d50 particle size of roofing granules disposed as a top surfacing in a lower adjacent zone to the small particulate zone. In various embodiments, the d95 particle size of the small particulate material is in the range of 1/10-½ of the d50 particle size of roofing granules disposed as a top surfacing in a lower adjacent zone to the small particulate zone, e.g., 1/10-⅓, or 1/10-¼, or 1/10-⅕, or ⅛-⅓, or ⅛-¼, or ⅛-⅕, or ⅙-⅓, or ⅙-¼.

The particle size of the small particulate material can vary, e.g., depending on the particle size of the roofing granules in the lower adjacent zone. For example, in certain embodiments as otherwise described herein, the small particulate material has a d50 particle size (and optionally a d95 particle size) of no more than 250 microns, e.g., no more than 200 microns, or no more than 150 microns, for example, in the range of 10-250 microns, e.g., 10-200 microns, or 10-150 microns or 25-250 microns, or 25-200 microns, or 25-150 microns, or 50-250 microns, or 50-200 microns. In certain embodiments as otherwise described herein, the small particulate material has a d50 particle size (and optionally a d95 particle size) of no more than 350 microns, e.g., no more than 300 microns, for example, in the range of 10-350 microns, e.g., 10-300 microns, or 25-350 microns, or 25-300 microns, or 50-350 microns, or 50-300 microns, or 100-350 microns, or 100-300 microns.

In certain embodiments as otherwise described herein, the small particulate material has a d50 particle size (and optionally a d95 particle size) of no more than 100 microns, e.g., no more than 80 microns, or no more than 60 microns, for example, in the range of 10-100 microns, e.g., 10-80 microns, or 10-60 microns or 25-100 microns, or 25-80 microns, or 25-60 microns.

The size of the roofing granules in the lower adjacent can also vary. For example, in certain embodiments as otherwise described herein, the roofing granules in the lower adjacent zone have a d50 of at least 300 microns, e.g., at least 350 microns, for example, in the range of 300-2000 microns, e.g., or 300-1500 microns, or 300-1000 microns, or 350-2000 microns, or 350-1500 microns, or 350-1000 microns. In certain embodiments as otherwise described herein, the roofing granules in the lower adjacent zone have a d50 of at least 400 microns, e.g., at least 450 microns, for example, in the range of 400-2000 microns, e.g., 400-1500 microns, or 400-1000 microns, or 450-2000 microns, or 450-1500 microns, or 450-1000 microns.

Notably, in desirable embodiments, a top surface of the surfacing in the small particulate zone can be recessed from a top surface of the roofing granules in the lower adjacent zone. For example, in certain embodiments, a top surface of the surfacing in the small particulate zone is recessed from a top surface of the roofing granules in the lower adjacent zone by at least 400 microns, e.g., at least 500 microns or at least 700 microns, for example, in the range of 400-1500 microns, or 400-1200 microns, or 400-1000 microns, or 500-1500 microns, or 500-1200 microns, or 500-1000 microns, or 700-1500 microns, or 700-1200 microns.

As described above, in some cases, the overlap of the small particulate zone and the overlap zone is partial, but not complete. For example, in the embodiment of FIG. 5, the small particulate zone 550 does not extend into the portion 555 of the overlap zone 540. In such embodiments, the remaining portion of the overlap zone that is surfaced with roofing granules (in FIG. 5, portion 555) can remain as a high-pressure area when the shingles are stacked. The present inventors note, however, that in many cases it can be desirable to retain such a portion of the overlap zone surfaced with roofing granules, in order to provide for flexibility in installation of the roofing shingle. To overcome this, the present inventors have determined that shingles can be stacked when packaged for shipping so that top surfaces of shingles can face one another in pairs. The shingles can be rotated 180 degrees relative to one another, and the portion of the overlap zone surfaced with roofing granules of a first shingle can be disposed against the small particulate zone of a second, facing shingle. In this way, the portion of the overlap zone surfaced with roofing granules of the first shingle can fit into the recess formed by the small particulate zone of the second shingle and be more protected from deformation.

The present inventors have noted that issues with sticking and deformation during shipment are especially acute with certain polymer-modified asphalt materials, such as elastomer-modified materials. Accordingly, in certain embodiments as otherwise described herein, in each of the overlay sheet and the underlay sheet, the top asphalt layer is formed of a polymer-modified asphalt material, e.g., an elastomer-modified asphalt material. For example, in certain such embodiments, the top asphalt layers are formed of an SBS-modified asphalt material, e.g., with a weight ratio of asphalt to SBS in the range 5-26, or 10-26. As the person of ordinary skill in the art would appreciate, SBS is a styrene/butadiene/styrene elastomer. Such materials can be highly impact resistant, which is advantageous in a roofing shingle. However, it can provide the shingle with a lowered resistance to pressure over time.

The person of ordinary skill in the art will appreciate that a variety of formulations of SBS-modified asphalt material can be used. In certain embodiments, the asphalt material includes SBS (e.g., in the range of 0.5-5 wt %, such as about 1.8 wt %); an unoxidized asphalt (e.g., in the range of 10-30 wt %, such as about 15.6 wt %), an oxidized asphalt (e.g., in the range of 10-30 wt %, such as about 17.5 wt %); and an inorganic filler (for example, limestone, e.g., in the range of 50-75 wt %, about 65.0 wt %). The unoxidized asphalt is typically first mixed with the SBS polymer, then the mixture is combined with the oxidized asphalt, as the viscosity of the mixture is too high when the SBS polymer is mixed into oxidized asphalt alone.

The present inventors note that the unoxidized asphalt is softer than the oxidized asphalt, and thus the mixed asphalt component of these materials is softer than the oxidized asphalt used in conventional shingles. For example, in certain embodiments, the asphalt component (i.e. including all bituminous materials in combination) of the asphalt material of the top layer of each of the overlay sheet and underlay sheet has a softening point of no more than 180° F., e.g., no more than 160° F., for example, in the range of 120-180° F., e.g., 120-160° F., or 130-180° F., or 130-160° F. This is in contrast to an oxidized asphalt typically used in bituminous shingles, which has a softening point of about 210° F. Softening points can be determined by ASTM D36. In certain embodiments, the asphalt component of the asphalt material of the top layer of each of the overlay sheet and underlay sheet has a penetration at 77° F. of at least 35 dmm (deci-millimeters), e.g., at least 50 dmm, for example, 35-85 dmm, e.g., 35-70 dmm, or 50-85 dmm, or 50-70 dmm. This is in contrast to an oxidized asphalt typically used in bituminous shingles, which has a penetration of 20 dmm. Penetration can be determined according to ASTM D5. Without intending to be bound by theory, the present inventors surmise that under pressure, the network of elastomeric polymer (e.g., SBS) in the overall material can deform, allowing the relatively soft asphalt component to be squeezed out of the elastomeric polymer matrix. The present inventors have noted that shingles based on these materials are especially susceptible to sticking and deformation, and as such that shingles based on these materials are especially advantaged when configured as described herein.

As described above, in some cases the asphalt material of the bottom asphalt layers of the overlay sheet and the underlay sheet can be different from the materials of their top layers. However, in certain desirable embodiments, the materials are similar, or even the same. Accordingly, in certain embodiments as otherwise described herein, in each of the overlay sheet and the underlay sheet, the bottom asphalt layer is formed of a polymer-modified asphalt, e.g., an elastomer-modified asphalt. In certain embodiments as otherwise described herein, in each of the overlay sheet and the underlay sheet the bottom asphalt layer is formed of SBS-modified asphalt, e.g., having a ratio of SBS to asphalt in the range of 5-26, or 10-26. Similarly, the asphalt component of the asphalt material of the top layer of each of the overlay sheet and underlay sheet has a softening point and/or a penetration value as described above.

Conventional shingle sheet constructions can be used to provide the overlay sheet and the underlay sheet. For example, in certain embodiments as otherwise described herein, in each of the overlay sheet and the underlay sheet, the substrate is a fibrous mat (e.g., a fiberglass mat or a roofing felt) that is saturated with one of the asphalt materials of the top asphalt layer and the bottom asphalt layer.

As is conventional, the shingle can include a nailing zone extending across the roofing shingle from the first end to the second end within the headlap section. The nailing zone is a zone that is suitable for fastening of the shingle to a roof surface. The nailing zone can be visually delineated at a top surface of the roofing shingle, e.g., by lines of paint. In the embodiment of FIG. 1, the nailing zone is indicated by reference number 114. The small particulate zone can, for example, overlap with the nailing zone. Further, in certain embodiments, the small particulate zone extends beyond the nailing zone. For example in the embodiment of FIG. 5, small particulate zone 550 extends beyond nailing zone 514.

In certain embodiments of the roofing shingle as otherwise described herein, the width of the roofing shingle is at least 24 inches, e.g., at least 30 inches, e.g., at least 42 inches. Further, in some embodiments, the width of the roofing shingle is no more than 48 inches, e.g., no more than 42 inches, e.g., no more than 40 inches. For example, in some embodiments, the width of the roofing shingle is in a range between 24 and 48 inches, e.g., in a range between 30 and 42 inches, e.g., in a range between 36 and 40 inches, e.g., 38¾ inches, or 39.4 inches (i.e., 1 m).

Further, in certain embodiments of the roofing shingle as otherwise described herein, the height of the headlap area is at least 4 inches, e.g., at least 6 inches, e.g., at least 7.25 inches. Further, in some embodiments, the height of the headlap area is no more than 14 inches, e.g., no more than 10 inches, e.g., no more than 7.75 inches. For example, in some embodiments, the height of the headlap area is in a range between 4 inches and 14 inches, e.g., in a range between 6 and 10 inches, e.g., in a range between 7.25 inches and 7.75 inches, e.g., 7⅝ inches. Likewise, in certain embodiments of the roofing shingle as otherwise described herein, the height of the exposed area is at least 4 inches. Further, in some embodiments, the height of the exposed area is no more than 12 inches. For example, in some embodiments, the height of the exposed area is in a range between 4 and 12 inches, e.g., 5, inches, 6 inches, 7 inches, 7.5 inches, 8 inches or 10 inches. Further, in certain embodiments the height of the exposed area is in a range between 5¼ inches and 5¾ inches, e.g., 5⅝ inches.

Another aspect of the disclosure is a roofing system that includes a roof structure, a first roofing shingle according to the disclosure disposed on the roof structure, and a first mechanical fastener securing the first roofing shingle to the roof structure. The first mechanical fastener is disposed within the nailing zone and passes through the overlay sheet. In some embodiments, the first mechanical fastener is one of a plurality of mechanical fasteners that secure the first roofing shingle to the roof structure. Various types of mechanical fasteners may be used to secure the first roofing shingle to the roof structure, including nails, staples, screws, or others.

In certain embodiments of the roofing system as otherwise described herein, the roof structure includes a frame and sheathing disposed over the frame. For example, the frame may be composed of frame elements such as rafters that support the sheathing. Further in some embodiments, the sheathing is continuous and forms a continuous surface over the frame elements. In other embodiments, the sheathing includes spaced sections. For example, the sheathing may be formed of a series of planks with a gap therebetween.

In certain embodiments of the roofing system as otherwise described herein, a second roofing shingle is disposed on top of the first roofing shingle so as to cover a portion of the headlap section of the first roofing shingle while leaving the exposure section of the first roofing shingle uncovered. A second mechanical fastener secures the second roofing shingle to the roof structure. The second mechanical fastener is disposed within the nail zone of the second roofing shingle and passes through the overlay sheet of the second roofing shingle. In some embodiments, the second mechanical fastener is one of a plurality of mechanical fasteners that secure the second roofing shingle to the roof structure. The second roofing shingle is part of a second course of shingles that are disposed over a first course of shingles which includes the first roofing shingle.

Figure 9:
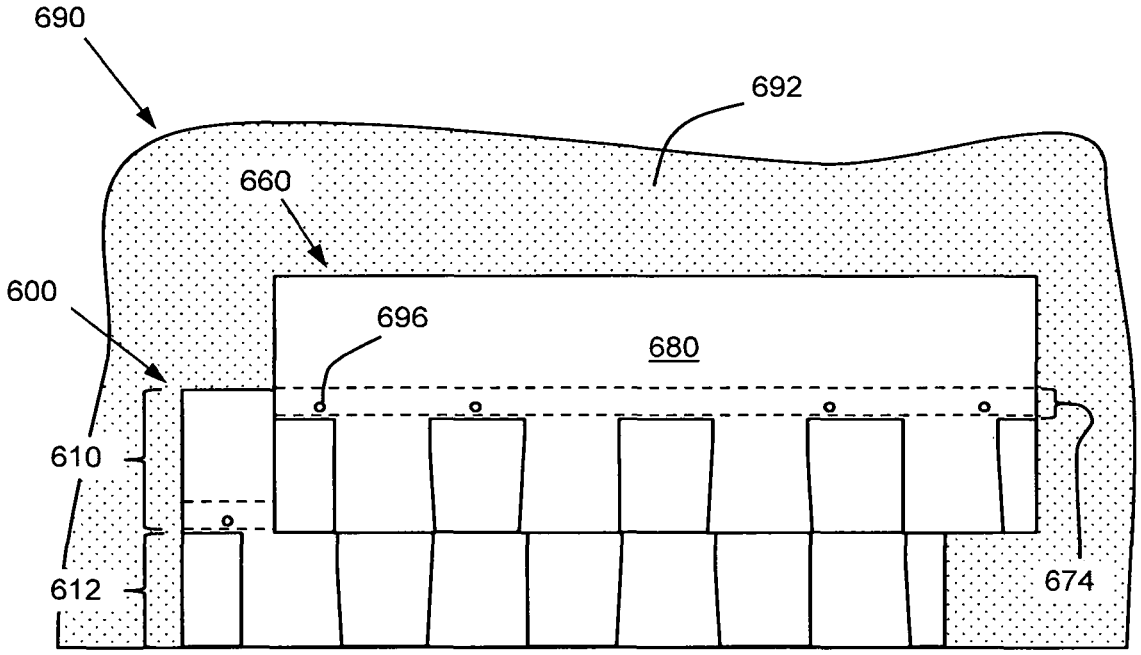

Such a roofing system is shown in FIG. 9. Roofing system 690 includes first roofing shingle 600 disposed on a roof structure 692. A second roofing shingle 660 is disposed on top of first roofing shingle 600 so as to overlap with a majority of the headlap section 610 but leave exposure section 612 uncovered. Further, the lateral position of second roofing shingle 660 is staggered or offset with respect to first roofing shingle 600 such that second roofing shingle 660 covers a majority but not all of the headlap section 610 of first roofing shingle 600. A second mechanical fastener passes through the overlay sheet 680 to secure the second roofing shingle 660 to the roof structure 692. In some embodiments, the first and second roofing shingles are part of a finished roofing system where further roofing shingles cover the remaining areas of the roof structure. In such an embodiment another roofing shingle would cover the remaining exposure portion of the headlap section of the first shingle, and other roofing shingles would cover the headlap section of the second roofing shingle.

In certain embodiments of the roofing system as otherwise described herein, the second mechanical fastener also passes through the first roofing shingle. For example, in some embodiments, the headlap section of each of the roofing shingles is larger than the exposure section. Accordingly, when the second roofing shingle is position on top of the first roofing shingle so as to overlap the headlap section of the first roofing shingle but leave the exposure section uncovered, the upper end of the headlap section of the first roofing shingle overlaps with the lower end of the second roofing shingle. In particular, the nailing zone of the second roofing shingle overlaps with the upper end of the headlap section of the first shingle. Consequently, when a mechanical fastener is inserted through the nailing zone of the second roofing shingle, the mechanical fastener also passes through the first roofing shingle at the upper end of the headlap section. For example, in roofing system 690, as shown in FIG. 9, the second mechanical fastener 696 passes through the second roofing shingle 660 so as to secure the second roofing shingle 660 to the roof structure 692. The second mechanical fastener also passes through the headlap section 610 of first roofing shingle 600.

Figure 6:
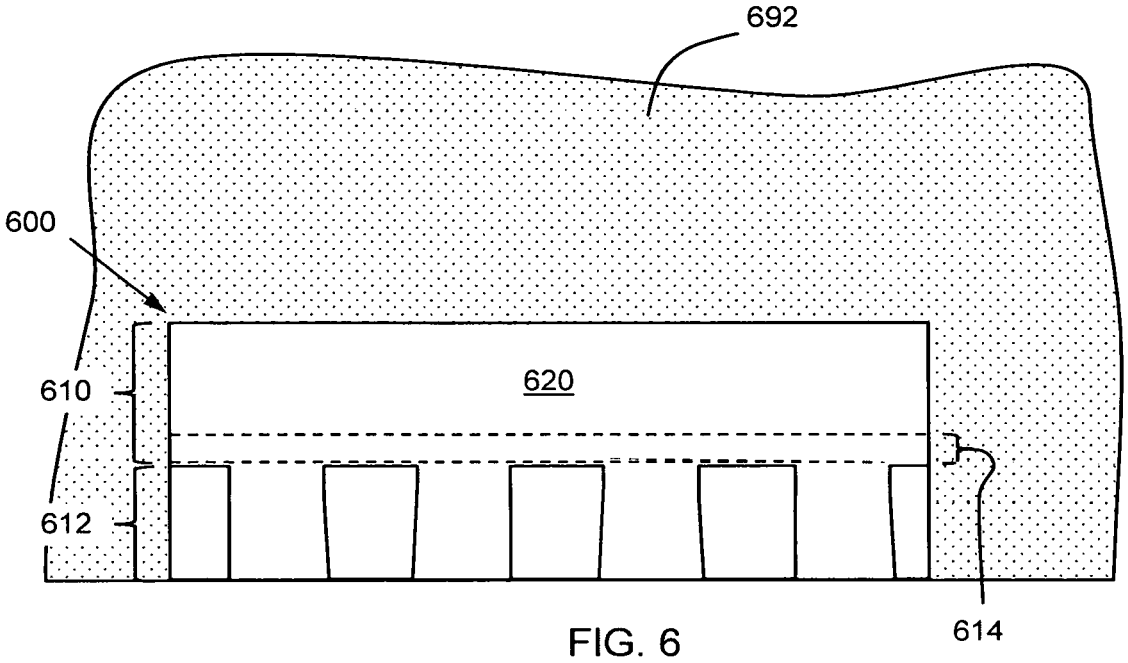
FIGS. 6 and 7 are schematic top views of the installation of a first roofing shingle on a roof surface according to one embodiment of the disclosure.
Figure 7:
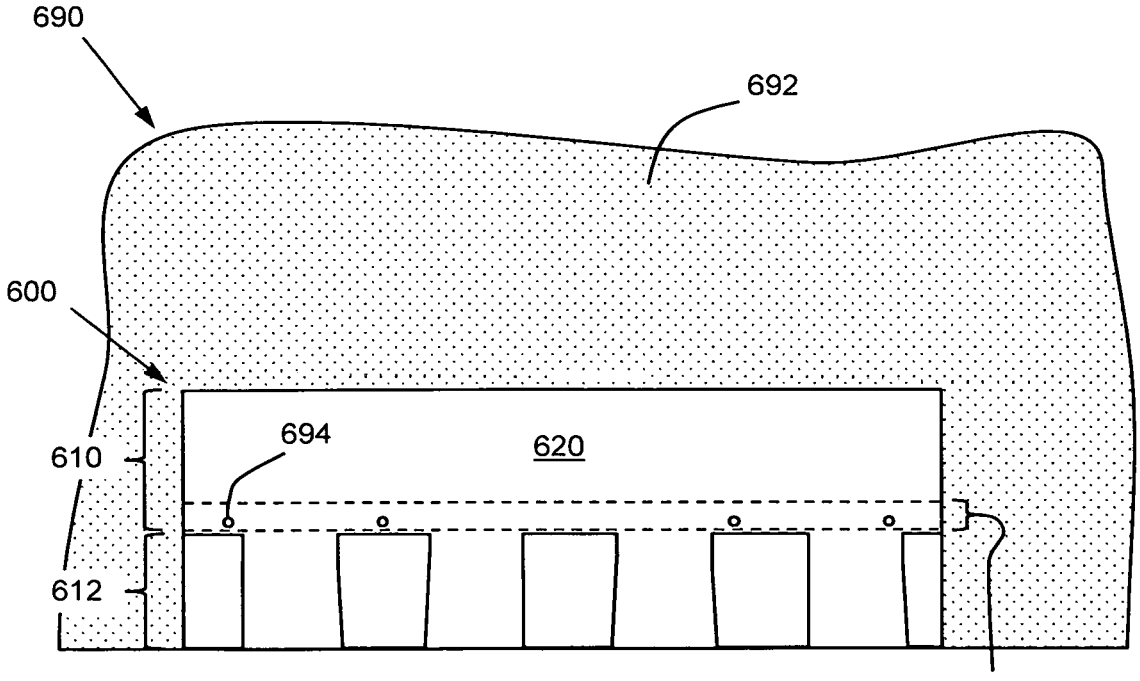

Another aspect of the disclosure is a method of installing a roofing system according to the disclosure. The method includes positioning a first roofing shingle according to the disclosure on a roof structure. The method also includes driving a first mechanical fastener through the nail zone of the first roofing shingle and into the roof structure so as to secure the first roofing shingle to the roof structure. The first mechanical fastener passes through the top shingle layer of the first roofing shingle. Such a method is illustrated in FIGS. 6 and 7. As shown in FIG. 6, first roofing shingle 600 is placed on roofing structure 692. Subsequently, as shown in FIG. 7, a group of mechanical fasteners including first mechanical fastener 694 are driven through first roofing shingle 600 into roof structure 692 so as to secure first roofing shingle 600 to the roof structure 692. The first mechanical fastener 694 and the other mechanical fasteners are positioned in the nailing zone 614 of the first roofing shingle 600 through the top shingle layer 620, thereby forming roofing system 690.

In certain embodiments of the method as otherwise described herein, the roof structure includes a frame and sheathing disposed over the frame, and the first mechanical fastener extends through the sheathing. In some embodiments the first mechanical fastener is extends through the entire thickness of the sheathing. In other embodiments the first mechanical fastener extends partially through the thickness of the sheathing. Other mechanical fasteners in the roofing system can be driven to a similar depth.

Figure 8:
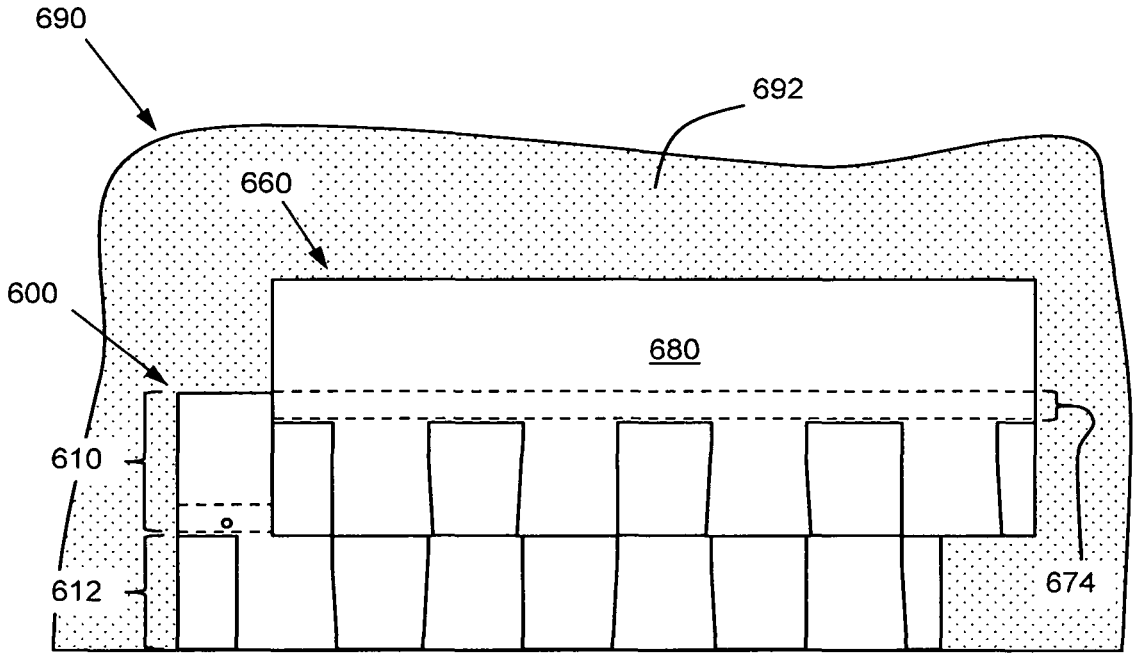
FIGS. 8 and 9 are schematic top views of the installation of a second roofing shingle on a roof surface according to one embodiment of the disclosure.

In certain embodiments of the method as otherwise described herein, the method includes positioning a second roofing shingle according to the disclosure on top of the first roofing shingle so as to cover a portion of the headlap section of the first roofing shingle while leaving the exposure section of the first roofing shingle uncovered. A second mechanical fastener is driven through the nailing zone of the second roofing shingle and into the roof structure so as to secure the second roofing shingle to the root structure. The second mechanical fastener passes through the overlay sheet of the second roofing shingle. Such a method is shown in FIGS. 8 and 9, which continues the method shown in FIGS. 6 and 7. As shown in FIG. 8, a second roofing shingle 660 is placed on top of the first roofing shingle 600 so as to cover a portion of the headlap section 610 of first roofing shingle 600. The second roofing shingle 660 is positioned such that the exposure section 612 of first roofing shingle 600 remains uncovered. A group of mechanical fasteners including second mechanical fastener 696 are driven through the nailing zone 674 of second roofing shingle 660 so as to secure second roofing shingle 660 to roof structure 692. The mechanical fasteners extend through the overlay sheet 680 of second roofing shingle 660.

In certain embodiments of the method as otherwise described herein, the second mechanical fastener is driven through a portion of the first roofing shingle. For example, in roofing system 690, second mechanical fastener 696 is driven through the upper end of headlap section 610 of first roofing shingle 600.

The roofing shingles described herein can be packaged in a variety of ways. For example, in certain embodiments, a plurality of roofing shingles as otherwise described herein are packaged as a stack in a bundle, e.g., in the range of 16-30 shingles per bundle. Roofing can be provided as a palleted plurality of roofing shingles, for example, comprising a plurality of roofing shingles as described herein, disposed in one or more stacks on a pallet. In certain desirable embodiments, the pallets are "double-stacked," i.e., with one pallet loaded with shingles on top of another pallet loaded with shingles.

In certain embodiments as otherwise described herein, the pallet has a top surface formed of a plurality of top boards, wherein (a) adjacent boards of the plurality of top boards have a gap of no more than one inch therebetween at the top surfaces thereof; and/or (b) the plurality of top boards take up at least 85% of the occluded area of the top surface of the pallet;

(c) each of the plurality of top boards has a thickness of at least 0.55 inches.

And such pallets can be useful even when used independently of the advances in shingle design as described above. Accordingly, another aspect of the disclosure is a palleted plurality of roofing shingles comprising a plurality of roofing shingles disposed in one or more stacks on a pallet, wherein the pallet has a top surface formed of a plurality of top boards, and wherein (a) adjacent boards of the plurality of top boards have a gap of no more than one inch therebetween at the top surfaces thereof; and/or (b) the plurality of top boards take up at least 85% of the occluded area of the top surface of the pallet;

(c) each of the plurality of top boards has a thickness of at least 0.55 inches, and wherein each roofing shingle has an upper edge, a lower edge, a first end, and a second end, each roofing shingle comprising:

a headlap section extending from the upper edge of the shingle toward the lower edge;

an exposure section below the headlap section and extending from a lower edge of the headlap section to the lower edge of the shingle; and a nailing lone extending across the roofing shingle from the first end to the second end within the headlap section, the roofing shingle being formed of an overlay sheet having a top surface and a bottom surface; and an underlay sheet having a top surface and a bottom surface, each of the overlay sheet and the underlay sheet comprising a substrate, a top asphalt layer extending from a top surface of the substrate and being surfaced with one or more top surfacings, and a bottom asphalt layer extending from a bottom surface of the substrate and being surfaced with one or more bottom surfacings, the overlay layer overlapping the underlay sheet along an overlap zone extending from the first end to the second end of the roofing shingle in or adjacent the nailing zone, with the top surface of the underlay sheet being affixed to the bottom surface of the overlay sheet in the overlap zone, the top surfacings of any exposed area of the overlap sheet and the underlay sheet in the exposure zone being roofing granules, optionally wherein (a) the bottom portion of each of the overlay sheet and the underlay sheet comprising the bottom asphalt layer and the one or more bottom surfacings has a weight of no more than 11 pounds per 100 square feet, and/or (b) the shingle has at its top surface a small particulate zone defined by a top surfacing of a small particulate material extending from the first end to the second end of the roofing shingle, the small particulate material having a d50 particle size of no more than half a d50 particle size of roofing granules disposed as a top surfacing in a lower adjacent zone to the small particulate zone, the small particulate zone being at least one inch in height as measured in a direction from the upper edge to the lower edge of the shingle, the small particulate zone at least partially overlapping the overlap zone.

The shingles can be packaged in one or more bundles making up each stack, as is conventional. As the person of ordinary skill in the art will appreciate, each bundle can include any desired number of shingles, e.g., in the range of 16-30, for example, 20 shingles per bundle or 22 shingles per bundle Shingles can be packaged face-to-face in pairs; in certain embodiments, a portion of the overlap zone surfaced with roofing granules of a first shingle is disposed against the small particulate zone of a second, facing shingle, as described above. Bundles can be stacked on a pallet in any desirable manner. A pallet can have bundles of shingles stacked, for example, in 6-15 bundle-high courses, e.g., 8-12 bundles high.

In especially advantageous embodiments, the roofing shingles include the polymer-modified, e.g., elastomer-modified asphalt materials described above. For example, in certain embodiments, in each roofing shingle, in each of the overlay sheet and the underlay sheet the bottom asphalt layer is formed of SBS-modified asphalt, e.g., having a ratio of SBS to asphalt in the range of 5-26, or 10-26. In certain embodiments, in each roofing shingle, the asphalt component of the asphalt material of the top layer of each of the overlay sheet and underlay sheet has a softening point of no more than 180° F., e.g., no more than 160° F., for example, in the range of 120-180° F., e.g., 120-160° F., or 130-180° F., or 130-160° F.; and/or a penetration at 77° F. of at least 35 dmm (deci-millimeters), e.g., at least 50 dmm, for example, 35-85 dmm, e.g., 35-70 dmm, or 50-85 dmm, or 50-70 dmm. The roofing shingles can otherwise be as described above with respect to the roofing shingles of the disclosure.

Figure 10:
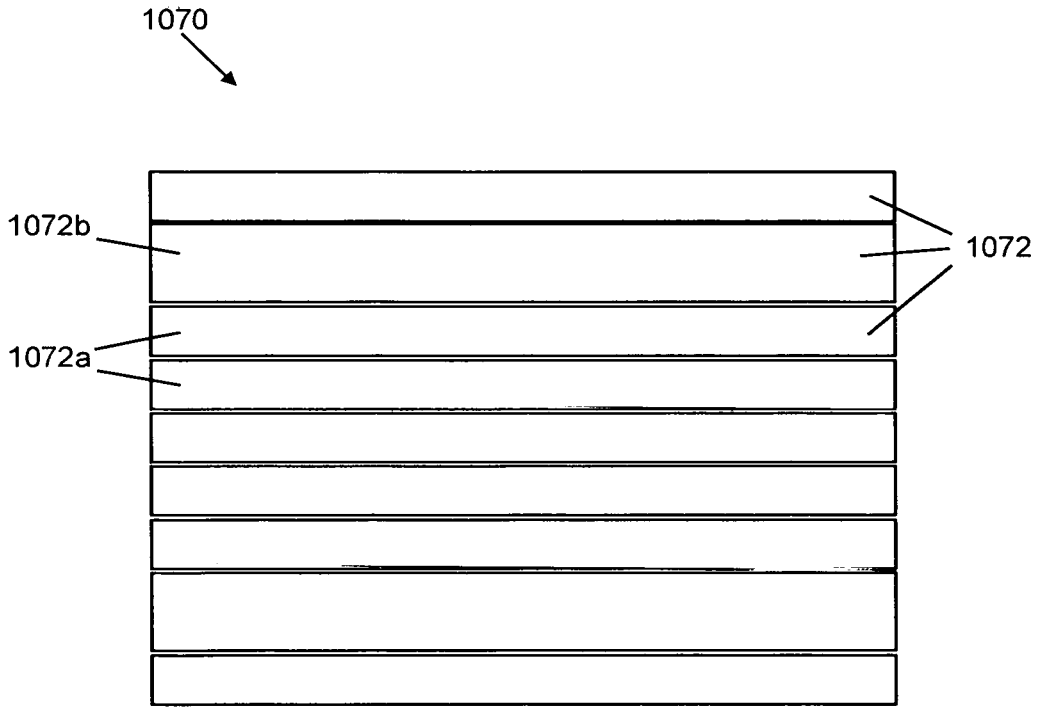
FIG. 10 is a schematic top view of a pallet useful in various embodiments of the disclosure.
Figure 11:
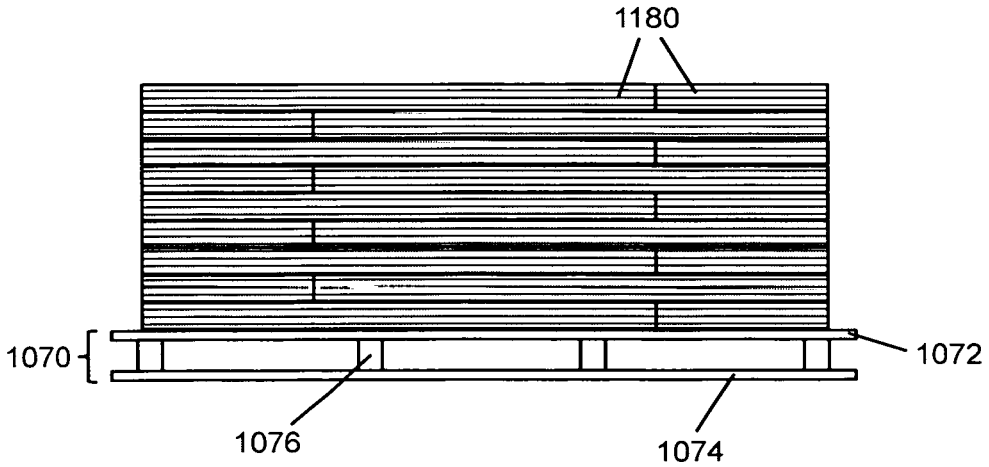
FIG. 11 is a schematic side view of the pallet of FIG. 10, loaded with bundles of shingles.

An example of a pallet is shown in schematic top view in FIG. 10, and in schematic side view (with shingles stacked thereon) in FIG. 11. Pallet 1070 includes a plurality of top boards 1072 and a plurality of bottom boards 1074, affixed (e.g., via nails or screws) to opposite sides of a series of stringers 1076. Notably, the top boards need not be uniform; for example, in the embodiment of FIGS. 10 and 11, there are two types of top boards with different widths, 1072*a* (narrower) and 1072*b* (wider). In FIG. 11, bundles 1180 are stacked on the pallet. Each bundle has, e.g., 20 or 22 roofing shingles. And there are nine courses of bundles stacked on the pallet; each course has three bundles extending parallel to the plane of the page and one bundle extending perpendicular to the plane of the page, as is conventional. This is a single "stack" configuration; in certain desirable embodiments, another loaded pallet of shingles can be stacked on top to form a "double-stack."

Figure 12:
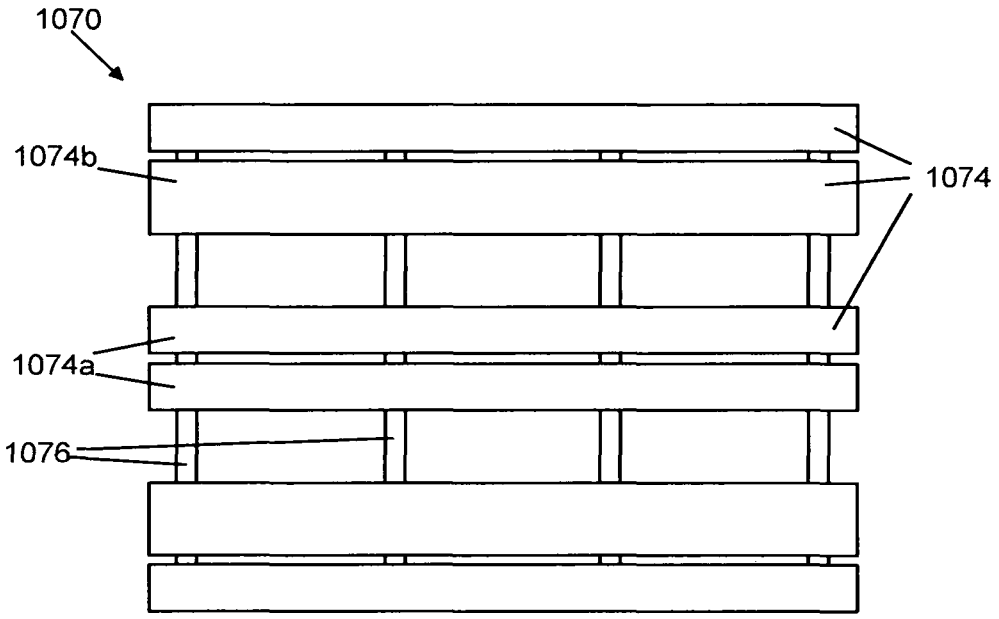
FIG. 12 is a schematic bottom view of the pallet of FIG. 10.
Figure 13:
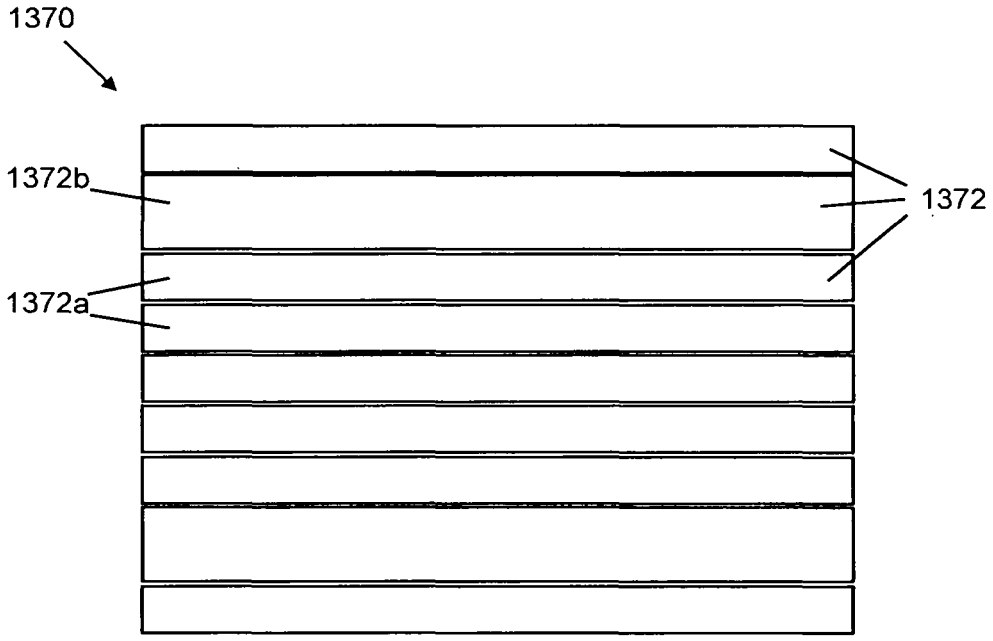
FIG. 13 is a schematic bottom view of another pallet useful in various embodiments of the disclosure.

FIGS. 12 and 13 exhibit two examples of arrangements of the plurality of bottom boards of pallets of the disclosure. FIG. 12 is a schematic bottom view of the pallet of FIG. 10. Pallet 1070 includes a plurality of bottom boards 1074 affixed (e.g., via nails or screws) to bottom sides of stringers 1076. Like the top boards, the bottom boards need not be uniform; for example, in the embodiment of FIG. 12, there are two types of bottom boards with different widths, 1074*a* (narrower) and 1074*b* (wider). Notably, in this embodiment, as is common for pallets, the bottom boards do not substantially fill the area at the bottom of the pallet.

FIG. 13 is a schematic bottom view of another pallet useful in various embodiments of the disclosure. In this embodiment, the structure of the top boards and the stringers is as described above with respect to FIGS. 10 and 11. Here, the bottom boards substantially fill the area at the bottom of the pallet.

Figure 14:
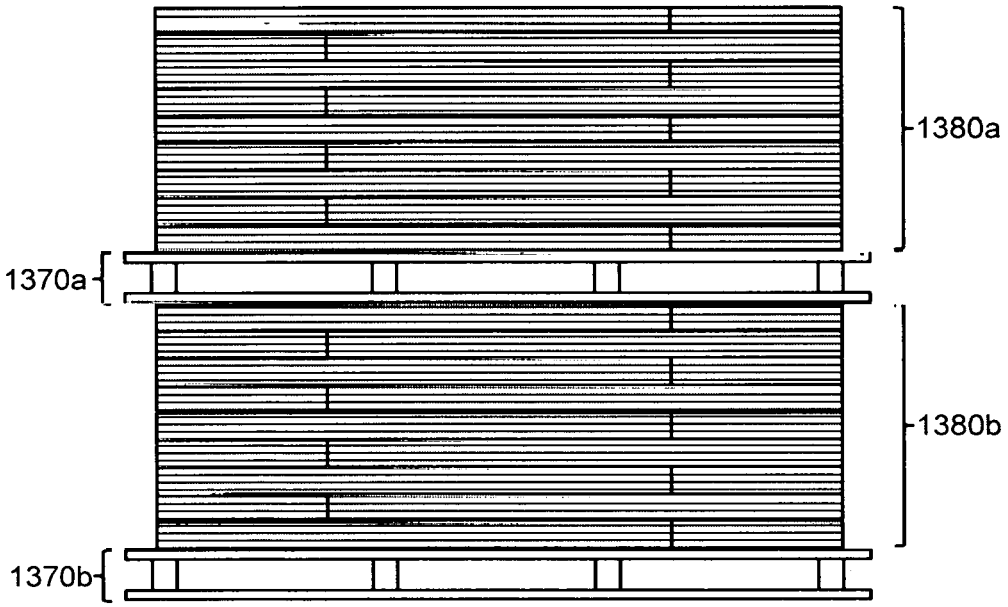
FIG. 14 is a schematic side view of a double-stack of palleted bundles of shingles using the pallet of FIG. 13.

FIG. 14 is a schematic side view of a so-called "double stack" of palleted roofing shingles. Here, the double stack of palleted roofing shingles includes a top palleted plurality of roofing shingles and a bottom palleted plurality of roofing shingles, with the pallet of the top palleted plurality of roofing shingles resting on a top of shingles of the bottom palleted plurality of roofing shingles. In the embodiment of FIG. 14, the top palleted plurality of shingles includes pallet 1370*a* and bundles 1380*a* of shingles stacked thereon. Similarly, the bottom palleted plurality of shingles includes pallet 1370*b* and bundles 1380*b* of shingles stacked thereon. And here, the pallet 1370*a* of the top palleted plurality of shingles rests on shingles of the bundles 1380*b* of shingles of the bottom palleted plurality of shingles. The present inventors have determined that the configurations described herein are especially desirable in such double stacks, as such can be especially prone to sticking and deformation.

The present inventors have determined a number of pallet characteristics that can reduce the propensity for damage of stacked shingles thereon, especially impact-resistant shingles as described herein. These advances can be used separately or in any combination, and can optionally be used with shingles having the advances as described herein. Without intending to be bound by theory, the present inventors believe that the pallet characteristics described herein can provide for an increased degree of support to the shingles and thus a reduced degree of sagging of the stacks.

For example, in certain embodiments as otherwise described herein, adjacent boards of the plurality of top boards have a gap of no more than one inch therebetween at the top surfaces thereof. For example, in certain embodiments as otherwise described herein, adjacent boards of the plurality of top boards have a gap of no more than 0.7 inches, e.g., no more than 0.4 inches or even no more than 0.3 inches, therebetween at the top surfaces thereof. In certain embodiments, adjacent boards of the plurality of top boards have a gap in the range of 0.01-0.7 inches therebetween at the top surfaces thereof, e.g., 0.01-0.4 inches, or 0.01-0.3 inches, or 0.02-0.7 inches, or 0.02-0.4 inches, or 0.02-0.3 inches, or 0.05-0.7 inches, or 0.05-0.4 inches, or 0.05-0.3 inches, or 0.1-0.7 inches, or 0.1-0.4 inches, or 0.1-0.3 inches. For example, in one example of a pallet according to FIGS. 10 and 11, there is a 0.28 inch gap between adjacent boards at top surfaces thereof. This can be contrasted with a pallet conventionally used to ship roofing shingles, which has gaps of 1.29 inches between adjacent boards.

In certain embodiments as otherwise described herein, the plurality of top boards take up at least 85% of the occluded area of the top surface of the pallet. As used herein, the "occluded area" is the area of the periphery of the pallet, i.e., treated as a rectangle. For example, in certain embodiments as otherwise described herein, the plurality of top boards take up at least 90% of the occluded area of top surface of the pallet, e.g., at least 93%. In certain embodiments as otherwise described herein, the plurality of top boards take up in the range of 85-99% of the occluded area of top surface of the pallet, e.g., in the range of 85-97%, or 85-95%, or 90-99%, or 90-97%, or 90-95%, or 92-99%, or 92-97%, or 92-95%. In one example of a pallet according to FIGS. 10 and 11, there are nine top boards in total, seven 3.75 inches in width and two 5.75 inches in width, with a 0.28 inch gap between them. This takes up about 94% of the occluded area. This can be contrasted with a pallet conventionally used to ship roofing shingles, which has seven top boards in total, four 3.75 inches in width and three 5.75 inches in width, with a 1.29 inch gap between them. This takes up about 81% of the occluded area.

In certain embodiments of the palleted pluralities of shingles as described herein, each of the plurality of top boards of the pallet has a thickness of at least 0.55 inches. For example, in certain embodiments, each of the plurality of top boards has a thickness of at least 0.57 inches, e.g., at least 0.6 inches. In certain embodiments, each of the plurality of top boards has a thickness in the range of 0.5-0.75 inches, e.g., 0.57-0.75 inches, or 0.6-0.75 inches, or 0.5-0.7 inches, or 0.57-0.7 inches, or 0.6-0.7 inches, or 0.5-0.65 inches, or 0.57-0.65 inches, or 0.6-0.65 inches. In one example of a pallet according to FIGS. 10 and 11, the top boards are ⅝ inch in thickness. This can be contrasted with a pallet conventionally used to ship roofing shingles, in which the top boards are ½ inch in thickness.

The top boards can be made out of a variety of materials; wood materials are convenient. In certain embodiments as otherwise described herein, the top board are formed of pine wood.

For example, in certain embodiments as otherwise described herein, adjacent boards of the plurality of bottom boards have a gap of no more than one inch therebetween at the bottom surfaces thereof. For example, in certain embodiments as otherwise described herein, adjacent boards of the plurality of bottom boards have a gap of no more than 0.7 inches, e.g., no more than 0.4 inches or even no more than 0.3 inches, therebetween at the bottom surfaces thereof. In certain embodiments, adjacent boards of the plurality of bottom boards have a gap in the range of 0.01-0.7 inches therebetween at the bottom surfaces thereof, e.g., 0.01-0.4 inches, or 0.01-0.3 inches, or 0.02-0.7 inches, or 0.02-0.4 inches, or 0.02-0.3 inches, or 0.05-0.7 inches, or 0.05-0.4 inches, or 0.05-0.3 inches, or 0.1-0.7 inches, or 0.1-0.4 inches, or 0.1-0.3 inches. For example, in one example of a pallet according to FIGS. 10 and 11, there is a 0.28 inch gap between adjacent boards at bottom surfaces thereof. This can be contrasted with a pallet conventionally used to ship roofing shingles, which has gaps of 1.29 inches between adjacent boards.

In certain embodiments as otherwise described herein, the plurality of bottom boards take up at least 85% of the occluded area of the bottom surface of the pallet. As used herein, the "occluded area" is the area of the periphery of the pallet, i.e., treated as a rectangle. For example, in certain embodiments as otherwise described herein, the plurality of bottom boards take up at least 90% of the occluded area of bottom surface of the pallet, e.g., at least 93%. In certain embodiments as otherwise described herein, the plurality of bottom boards take up in the range of 85-99% of the occluded area of bottom surface of the pallet, e.g., in the range of 85-97%, or 85-95%, or 90-99%, or 90-97%, or 90-95%, or 92-99%, or 92-97%, or 92-95%. In one example of a pallet according to FIG. 13, there are nine bottom boards in total, seven 3.75 inches in width and two 5.75 inches in width, with a 0.28 inch gap between them. This takes up about 94% of the occluded area.

In certain embodiments of the palleted pluralities of shingles as described herein, each of the plurality of bottom boards of the pallet has a thickness of at least 0.55 inches. For example, in certain embodiments, each of the plurality of bottom boards has a thickness of at least 0.57 inches, e.g., at least 0.6 inches. In certain embodiments, each of the plurality of bottom boards has a thickness in the range of 0.5-0.75 inches, e.g., 0.57-0.75 inches, or 0.6-0.75 inches, or 0.5-0.7 inches, or 0.57-0.7 inches, or 0.6-0.7 inches, or 0.5-0.65 inches, or 0.57-0.65 inches, or 0.6-0.65 inches. In one example of a pallet according to FIGS. 10 and 11, the bottom boards are ⅝ inch in thickness.

The bottom boards can be made out of a variety of materials; wood materials are convenient. In certain embodiments as otherwise described herein, the bottom board are formed of pine wood.

In certain embodiments of the palleted pluralities as described herein, a stack of shingles supported by the pallet can be, e.g., at least 225 shingles in height, e.g., at least 250, at least 300, or even at least 350 shingles in height, for example, in the range of 225-450, or 225-410, 250-450, or 250-410, or 300-450, or 300-410, or 350-450, or 350-410 shingles in height. The present inventors have found that even impact-resistant shingles, when configured as described herein, can be successfully shipped with reduced deformation and sticking as compared to conventional impact-resistant shingles. Here, a number of shingles "supported by" a bottom pallet in a double-stack is the total number of shingles on each pallet, including those disposed on the bottom pallet and those disposed on a top pallet of the double-stack. Thus, in a double-stack, well in excess of 300 shingles in height can be supported by the bottom pallet. This is contrasted with current impact-resistant shingles, which are often palleted only in "single stacks" of no more than about 200 shingles in height.

The present inventors have noted that use of the advances described herein can allow for shingles to be stacked in relatively high masses For example, in certain embodiments as otherwise described herein, the pallet of a palleted plurality of roofing shingles supports an average mass per unit area (i.e., of the area on which shingles are stacked) of at least 1.50 lb/in$^2$, e.g., at least 1.68 lb/in$^2$, or at least 2.02 lb/in$^2$, or at least 2.36 lb/in$^2$, for example, in the range of 1.50-3.03 lb/in$^2$, e.g., in the range of 1.50-2.76 lb/in$^2$, or 1.68-3.03 lb/in$^2$, or 1.68-2.76 lb/in$^2$, or 2.02-3.03 lb/in$^2$, or 2.02-2.76 lb/in$^2$, or 2.35-3.03 lb/in$^2$, or 2.35-2.76 lb/in$^2$. For the bottom pallet of a double-stack, this mass includes not only the shingles but also a top pallet of the stack. This can be contrasted with current impact-resistant shingles, which are often palleted only at masses per unit area of about 1.35 lb/in$^2$ or less.

In an example, shingles were made with an SBS-modified asphalt as described above, generally with the structure described above with respect to FIG. 5, including a reduced weight in the bottom portions of the overlay and underlay sheets and a small particle zone. Sand was used as a surfacing on the bottom surfaces of the shingles, while roofing granules (about 420 microns in size) were used on the top surfaces, but for the use of sand (about 74 microns in size) in a 2 inch zone overlapping the overlap zone. Shingles were bundled in bundles of 20 or 22 shingles, and stacked on the example pallet described herein with respect to FIGS. 10-12, with about 380 shingles stack height. The pallet was shipped from Minnesota to Texas, then evaluated for sticking and deformation. No sticking and deformation was observed in any of the bundles.

Good performance was exhibited using a pallet described herein with respect to FIG. 13 in a so-called "double stack" of palleted pluralities of shingles as described above. The arrangement of shingles on each pallet were as described above with respect to FIGS. 10-12, with a top loaded pallet sitting on the shingles of a bottom loaded pallet, as shown in FIG. 14. A over the course of a week on a railcar in a railyard in Minnesota, a week in transit from Minnesota to Texas, and three days in a railyard in Texas. Temperatures ranged from the mid-40s to the high 90s degrees Fahrenheit, with an average temperature of about 72 degrees Fahrenheit. No sticking and deformation was observed in any of the bundles.

Various additional aspects and embodiments of the disclosure are illustrated by the following enumerated embodiments, which may be combined in any number and in any fashion not logically or technically inconsistent.

Embodiment 1. A roofing shingle having an upper edge, a lower edge, a first end, and a second end, the roofing shingle comprising:

- a headlap section extending from the upper edge of the shingle toward the lower edge;
- an exposure section below the headlap section and extending from a lower edge of the headlap section to the lower edge of the shingle; and
- a nailing zone extending across the roofing shingle from the first end to the second end within the headlap section, the roofing shingle being formed of

- an overlay sheet having a top surface and a bottom surface; and
- an underlay sheet having a top surface and a bottom surface,
- each of the overlay sheet and the underlay sheet comprising
  - a substrate,
  - a top asphalt layer extending from a top surface of the substrate and being surfaced with one or more top surfacings, and
  - a bottom asphalt layer extending from a bottom surface of the substrate and being surfaced with one or more bottom surfacings,
- the overlay layer overlapping the underlay sheet along an overlap zone extending from the first end to the second end of the roofing shingle in or adjacent the nailing zone, with the top surface of the underlay sheet being affixed to the bottom surface of the overlay sheet in the overlap zone,
- the top surfacings of any exposed area of the overlap sheet and the underlay sheet in the exposure zone being roofing granules;

wherein

- (a) a bottom portion of each of the overlay sheet and the underlay sheet comprising the bottom asphalt layer and the one or more bottom surfacings has a weight of no more than 11 pounds per 100 square feet, and/or
- (b) the shingle has at its top surface a small particulate zone defined by a top surfacing of a small particulate material extending from the first end to the second end of the roofing shingle, the small particulate material having a d50 particle size of no more than half a d50 particle size of roofing granules disposed as a top surfacing in a lower adjacent zone to the small particulate zone, the small particulate zone being at least one inch in height as measured in a direction from the upper edge to the lower edge of the shingle, the small particulate zone at least partially overlapping the overlap zone.

Embodiment 2. The roofing shingle according to embodiment 1, wherein the bottom portion of each of the overlay sheet and the underlay sheet comprising the bottom asphalt layer and the one or more bottom surfacings has a weight of no more than 10.7 pounds per 100 square feet, e.g., no more than 10.5 pounds per 100 square feet.

Embodiment 3. The roofing shingle according to embodiment 2, wherein the weight of the bottom portion of each of the overlay sheet and the underlay sheet is in the range of 9-11 pounds per 100 square feet, e.g., in the range of 9-10.7 pounds per 100 square feet, or 9-10.5 pounds per 100 square feet, or 9.5-11 pounds per 100 square feet, or 9.5-10.7 pounds per 100 square feet, or 9-10.5 pounds per 100 square feet.

Embodiment 4. The roofing shingle according to embodiment 2, wherein the weight of the bottom portion of each of the overlay sheet and the underlay sheet is in the range of 10-11 pounds per 100 square feet, e.g., in the range of 10-10.7 pounds per 100 square feet, or 10-10.5 pounds per 100 square feet, or 10.3-11 pounds per 100 square feet, or 10.3-10.7 pounds per 100 square feet, or 10.3-10.5 pounds per 100 square feet.

Embodiment 5. The roofing shingle according to any of embodiments 1-4, wherein the shingle has at its top surface a small particulate zone defined by a top surfacing of a small particulate material extending from the first end to the second end of the roofing shingle, the small particulate material having a d50 particle size of no more than half a d50 particle size of roofing granules disposed as a top surfacing in a lower adjacent zone to the small particulate zone, the small particulate zone being at least one inch in height as measured in a direction from the upper edge to the lower edge of the shingle, the small particulate zone at least partially overlapping a zone of overlap of the overlay sheet and the underlay sheet.

Embodiment 6. The roofing shingle according to embodiment 5, wherein the roofing shingle includes one or more areas where the overlay sheet is disposed on the underlay sheet with a degree of overlap of no more than 1.5 inches, e.g., no more than 1 inch.

Embodiment 7. The roofing shingle according to embodiment 5, wherein the roofing shingle includes one or more areas where the overlay sheet is disposed on the underlay sheet with a degree of overlap in the range of 0.3-1.5 inches, or 0.3-1 inch, or 0.5-1.5 inches, or 0.5-1 inch, or 0.75-1.5 inches.

Embodiment 8. The roofing shingle according to any of embodiments 5-7 wherein the small particulate material is sand.

Embodiment 9. The roofing shingle according to any of embodiments 5-7, wherein the small particulate material is mica flakes, copper slag, coal slag, sand, talc, expanded clay, slate flour, powdered limestone or silica dust or a combination thereof.

Embodiment 10. The roofing shingle according to any of embodiments 5-9, wherein the small particulate material has a d50 particle size of no more than ⅓ of (e.g., no more than % of, or no more than ⅕ of) a d50 particle size of roofing granules disposed as a top surfacing in a lower adjacent zone to the small particulate zone.

Embodiment 11. The roofing shingle according to any of embodiments 5-9, wherein the d50 particle size of the small particulate material is in the range of 1/10-½ of the d50 particle size of roofing granules disposed as a top surfacing in a lower adjacent zone to the small particulate zone, e.g., 1/10-⅓, or 1/10-¼, or 1/10-⅕, or ⅛-⅓, or ⅛-¼, or ⅛-⅕, or ⅙-⅓, or ⅙-¼.

Embodiment 12. The roofing shingle according to any of embodiments 5-11, wherein the small particulate material has a d95 particle size of no more than ½ of (e.g., no more than ¼ of, or no more than % of, or no more than ⅕ of) a d50 particle size of roofing granules disposed as a top surfacing in a lower adjacent zone to the small particulate zone Embodiment 13. The roofing shingle according to any of embodiments 5-11, wherein the d95 particle size of the small particulate material is in the range of 1/10-½ of the d50 particle size of roofing granules disposed as a top surfacing in a lower adjacent zone to the small particulate zone, e.g., 1/10-⅓, or 1/10-¼, or 1/10-⅕, or ⅛-⅓, or ⅛-¼, or ⅛-⅕, or ⅙-⅓, or ⅙-¼.

Embodiment 14. The roofing shingle according to any of embodiments 5-13, wherein the small particulate material has a d50 particle size (and optionally a d95 particle size) of no more than 250 microns, e.g., no more than 200 microns, or no more than 150 microns, for example, in the range of 25-250 microns, e.g., 25 200 microns, or 25-150 microns or 50-250 microns, or 50-200 microns, or 50-150 microns.

Embodiment 15. The roofing shingle according to any of embodiments 5-13, wherein the small particulate material has a d50 particle size (and optionally a d95 particle size) of no more than 350 microns, e.g., no more than 300 microns, for example, in the range of 10-350 microns, e.g., 10-300 microns, or 25-350 microns, or 25-300 microns, or 50-350 microns, or 50-300 microns, or 100-350 microns, or 100-300 microns.

Embodiment 16. The roofing shingle according to any of embodiments 5-15, wherein the roofing granules in the lower adjacent zone have a d50 of at least 300 microns, e.g., at least 350 microns, for example, in the range of 300-2000 microns, e.g., 300-1500 microns, or 300-1000 microns, or 350-2000 microns, or 350-1500 microns, or 350-1000 microns.

Embodiment 17. The roofing shingle according to any of embodiments 5-15, wherein the roofing granules in the lower adjacent zone have a d50 of at least 400 microns, e.g., at least 450 microns, for example, in the range of 400-2000 microns, e.g., 400-1500 microns, or 400-1000 microns, or 450-2000 microns, or 450-1500 microns, or 450-1000 microns.

Embodiment 18. The roofing shingle according to any of embodiments 5-17, wherein a top surface of the surfacing in the small particulate zone is recessed from a top surface of the roofing granules in the lower adjacent zone by at least 400 microns, e.g., at least 500 microns or at least 700 microns, for example, in the range of 400-1500 microns, or 400-1200 microns, or 400-1000 microns, or 500-1500 microns, or 500-1200 microns, or 500-1000 microns, or 700-1500 microns, or 700-1200 microns.

Embodiment 19. The roofing shingle according to any of embodiments 1-18, wherein in each of the overlay sheet and the underlay sheet, the top asphalt layer is formed of a polymer-modified asphalt material, e.g., an elastomer-modified asphalt material.

Embodiment 20. The roofing shingle according to any of embodiments 1-18, wherein the top asphalt layer is formed of SBS-modified asphalt material.

Embodiment 21. The roofing shingle according to embodiment 20, wherein a ratio of asphalt to SBS is in the range of 5-26, e.g., 10-26.

Embodiment 22. The roofing shingle according to any of embodiments 1-21, wherein the asphalt component of the asphalt material of the top layer of each of the overlay sheet and underlay sheet has a softening point of no more than 180° F., e.g., no more than 160° F., for example, in the range of 120-180° F., e.g., 120-160° F., or 130-180° F., or 130-160° F.

Embodiment 23. The roofing shingle according to any of embodiments 1-22, wherein the asphalt component of the asphalt material of the top layer of each of the overlay sheet and underlay sheet has a penetration at 77° F. of at least 35 dmm (deci-millimeters), e.g., at least 50 dmm, for example, 35-85 dmm, e.g., 35-70 dmm, or 50-85 dmm, or 50-70 dmm.

Embodiment 24. The roofing shingle according to any of embodiments 1-23, wherein in each of the overlay sheet and the underlay sheet, the bottom asphalt layer is formed of a polymer-modified asphalt, e.g., an elastomer-modified asphalt.

Embodiment 25. The roofing shingle according to any of embodiments 1-23, wherein in each of the overlay sheet and the underlay sheet the bottom asphalt layer is formed of SBS-modified asphalt, e.g., having a ratio of SBS to asphalt in the range of 5-26, e.g., 10-26.

Embodiment 26. The roofing shingle according to any of embodiments 1-25, wherein in each of overlay sheet and the underlay sheet, the top asphalt layer and the bottom asphalt layer are formed of the same asphalt material.

Embodiment 27. The roofing shingle according to any of embodiments 1-26, wherein in each of the overlay sheet and the underlay sheet, the substrate is a fibrous mat that is saturated with one of the asphalt materials of the top asphalt layer and the bottom asphalt layer.

Embodiment 28. The roofing shingle according to any of embodiments 1-27, wherein the nailing zone of the roofing shingle is visually delineated at a top surface of the roofing shingle.

Embodiment 29. The roofing shingle according to any of embodiments 1-28, wherein the overlay sheet comprises one or more tabs extending into the exposure zone, the one or more tabs being disposed on the underlay sheet.

Embodiment 30. A stack of roofing shingles according to any of embodiments 1-29 in which the overlap of the small particulate zone and the overlap zone is partial, but not complete, wherein shingles are stacked in facing pairs, wherein the portion of the overlap zone surfaced with roofing granules of a first shingle is disposed against the small particulate zone of a second, facing shingle.

Embodiment 31. A roofing system comprising:

a roof structure;

a first roofing shingle according to any of embodiments 1-30 disposed on the roof structure;

a first mechanical fastener securing the first roofing shingle to the roof structure, wherein the first mechanical fastener is disposed within the nailing zone and passes through the overlay sheet.

Embodiment 32. A method of installing a roofing system according to embodiment 31, the method comprising:

positioning the first roofing shingle on a roof structure; and driving a first mechanical fastener through the nailing zone of the first roofing shingle and into the roof structure so as to secure the first roofing shingle to the roof structure, wherein the first mechanical fastener passes through the overlay sheet.

Embodiment 33. A roofing system comprising:

a roof structure;

a first roofing shingle and a second roofing shingle, each according to any of embodiments 1-30, disposed on the roof structure, such that the second roofing shingle is disposed on top of the first roofing shingle so as to cover a portion of the headlap section of the first roofing shingle while leaving the exposure section of the first roofing shingle uncovered;

a first mechanical fastener securing the first roofing shingle to the roof structure, wherein the first mechanical fastener is disposed within the nailing zone and passes through the overlay sheet; and a second mechanical fastener securing the second roofing shingle to the roof structure, wherein the second mechanical fastener is disposed within the nailing zone of the second roofing shingle and passes through the overlay sheet of the second roofing shingle.

Embodiment 34. A plurality of roofing shingles according to any of embodiments 1-30, packaged as a stack in a bundle.

Embodiment 35. A palleted plurality of roofing shingles comprising a plurality of roofing shingles according to any of embodiments 1-30, disposed in one or more stacks on a pallet.

Embodiment 36. The palleted plurality of roofing shingles according to embodiment 35, wherein the pallet has a top surface formed of a plurality of top boards, and wherein (a) adjacent boards of the plurality of top boards have a gap of no more than one inch therebetween at the top surfaces thereof; and/or (b) the plurality of top boards take up at least 85% of the occluded area of the top surface of the pallet;

(c) each of the plurality of top boards has a thickness of at least 0.55 inches.

Embodiment 37. A palleted plurality of roofing shingles comprising a plurality of roofing shingles disposed in one or more stacks on a pallet, wherein the pallet has a top surface formed of a plurality of top boards, and wherein (a) adjacent boards of the plurality of top boards have a gap of no more than one inch therebetween at the top surfaces thereof; and/or (b) the plurality of top boards take up at least 85% of the occluded area of the top surface of the pallet;

(c) each of the plurality of top boards has a thickness of at least 0.55 inches, and wherein each roofing shingle has an upper edge, a lower edge, a first end, and a second end, each roofing shingle comprising:

a headlap section extending from the upper edge of the shingle toward the lower edge;

an exposure section below the headlap section and extending from a lower edge of the headlap section to the lower edge of the shingle; and a nailing zone extending across the roofing shingle from the first end to the second end within the headlap section, the roofing shingle being formed of an overlay sheet having a top surface and a bottom surface; and an underlay sheet having a top surface and a bottom surface, each of the overlay sheet and the underlay sheet comprising a substrate, a top asphalt layer extending from a top surface of the substrate and being surfaced with one or more top surfacings, and a bottom asphalt layer extending from a bottom surface of the substrate and being surfaced with one or more bottom surfacings, the overlay layer overlapping the underlay sheet along an overlap zone extending from the first end to the second end of the roofing shingle in or adjacent the nailing zone, with the top surface of the underlay sheet being affixed to the bottom surface of the overlay sheet in the overlap zone, the top surfacings of any exposed area of the overlap sheet and the underlay sheet in the exposure zone being roofing granules, optionally wherein (a) the bottom portion of each of the overlay sheet and the underlay sheet comprising the bottom asphalt layer and the one or more bottom surfacings has a weight of no more than 11 pounds per 100 square feet, and/or (b) the shingle has at its top surface a small particulate zone defined by a top surfacing of a small particulate material extending from the first end to the second end of the roofing shingle, the small particulate material having a d50 particle size of no more than half a d50 particle size of roofing granules disposed as a top surfacing in a lower adjacent zone to the small particulate zone, the small particulate zone being at least one inch in height as measured in a direction from the upper edge to the lower edge of the shingle, the small particulate zone at least partially overlapping the overlap zone.

Embodiment 38. The palleted plurality of roofing shingles according to any of embodiments 35-37, wherein the roofing shingles are packaged in one or more bundles.

Embodiment 39. The palleted plurality of roofing shingles according to any of embodiments 35-38, wherein in each roofing shingle, in each of the overlay sheet and the underlay sheet, the top asphalt layer is formed of a polymer-modified asphalt, e.g., an elastomer-modified asphalt.

Embodiment 40. The palleted plurality of roofing shingles according to any of embodiments 35-38, wherein in each roofing shingle, in each of the overlay sheet and the underlay sheet the bottom asphalt layer is formed of SBS-modified asphalt, e.g., having a ratio of SBS to asphalt in the range of 5-26, e.g., 10-26.

Embodiment 41. The palleted plurality of roofing shingles according to any of embodiments 30-36, wherein the asphalt component of the asphalt material of the top layer of each of the overlay sheet and underlay sheet has a softening point of no more than 180° F., e.g., no more than 160° F., for example, in the range of 120-180° F., e.g., 120-160° F., or 130-180° F., or 130-160° F.; and/or a penetration at 77° F. of at least 35 dmm (deci-millimeters), e.g., at least 50 dmm, for example, 35-85 dmm, e.g., 35-70 dmm, or 50-85 dmm, or 50-70 dmm.

Embodiment 42. The palleted plurality of roofing shingles according to any of embodiments 35-41, wherein each roofing shingle is as further defined in one or more of embodiments 2-18 and 24-30.

Embodiment 43. The palleted plurality of roofing shingles according to any of embodiments 35-42, wherein adjacent boards of the plurality of top boards have a gap of no more than one inch therebetween at the top surfaces thereof.

Embodiment 44. The palleted plurality of roofing shingles according to embodiment 35-42, wherein adjacent boards of the plurality of top boards have a gap of no more than 0.7 inches, e.g., no more than 0.4 inches or even no more than 0.3 inches, therebetween at the top surfaces thereof.

Embodiment 45. The palleted plurality of roofing shingles according to embodiment 35-42, wherein adjacent boards of the plurality of top boards have a gap in the range of 0.01-0.7 inches therebetween at the top surfaces thereof, e.g., 0.01-0.4 inches, or 0.01-0.3 inches, or 0.02-0.7 inches, or 0.02-0.4 inches, or 0.02-0.3 inches, or 0.05-0.7 inches, or 0.05-0.4 inches, or 0.05-0.3 inches, or 0.1-0.7 inches, or 0.1-0.4 inches, or 0.1-0.3 inches.

Embodiment 46. The palleted plurality of roofing shingles according to any of embodiments 35-45, wherein the plurality of top boards take up at least 85% of the occluded area of the top surface of the pallet.

Embodiment 47. The palleted plurality of roofing shingles according to embodiment 35-45, wherein the plurality of top boards take up at least 90% of the occluded area of top surface of the pallet, e.g., at least 93%.

48. The palleted plurality of roofing shingles according to embodiment 35-45, wherein the plurality of top boards take up in the range of 85-99% of the occluded area of top surface of the pallet, e.g., in the range of 85-97%, or 85-95%, or 90-99%, or 90-97%, or 90-95%, or 92-99%, or 92-97%, or 92-95%.

Embodiment 49. The palleted plurality of roofing shingles according to any of embodiments 35-48, wherein each of the plurality of top boards has a thickness of at least 0.55 inches.

Embodiment 50. The palleted plurality of roofing shingles according to any of embodiments 35-48, wherein each of the plurality of top boards has a thickness of at least 0.57 inches, e.g., at least 0.6 inches.

Embodiment 51. The palleted plurality of roofing shingles according to any of embodiments 35-48, wherein each of the plurality of top boards has a thickness in the range of 0.5-0.75 inches, e.g., 0.57-0.75 inches, or 0.6-0.75 inches, or 0.5-0.7 inches, or 0.57-0.7 inches, or 0.6-0.7 inches, or 0.5-0.65 inches, or 0.57-0.65 inches, or 0.6-0.65 inches.

Embodiment 52. The palleted plurality of roofing shingles according to any of embodiments 35-51, wherein the top boards are formed of pine wood.

Embodiment 53. The palleted plurality of roofing shingles according to any of embodiments 35-52, wherein adjacent boards of the plurality of bottom boards have a gap of no more than one inch therebetween at the bottom surfaces thereof.

Embodiment 54. The palleted plurality of roofing shingles according to embodiment 35-52, wherein adjacent boards of the plurality of bottom boards have a gap of no more than 0.7 inches, e.g., no more than 0.4 inches or even no more than 0.3 inches, therebetween at the bottom surfaces thereof.

Embodiment 55. The palleted plurality of roofing shingles according to embodiment 35-52, wherein adjacent boards of the plurality of bottom boards have a gap in the range of 0.01-0.7 inches therebetween at the bottom surfaces thereof, e.g., 0.01-0.4 inches, or 0.01-0.3 inches, or 0.02-0.7 inches, or 0.02-0.4 inches, or 0.02-0.3 inches, or 0.05-0.7 inches, or 0.05-0.4 inches, or 0.05-0.3 inches, or 0.1-0.7 inches, or 0.1-0.4 inches, or 0.1-0.3 inches.

Embodiment 56. The palleted plurality of roofing shingles according to any of embodiments 35-55, wherein the plurality of bottom boards take up at least 85% of the occluded area of the bottom surface of the pallet.

Embodiment 57. The palleted plurality of roofing shingles according to embodiment 35-55, wherein the plurality of bottom boards take up at least 90% of the occluded area of bottom surface of the pallet, e.g., at least 93%.

Embodiment 58. The palleted plurality of roofing shingles according to embodiment 35-55, wherein the plurality of bottom boards take up in the range of 85-99% of the occluded area of bottom surface of the pallet, e.g., in the range of 85-97%, or 85-95%, or 90-99%, or 90-97%, or 90-95%, or 92-99%, or 92-97%, or 92-95%.

Embodiment 59. The palleted plurality of roofing shingles according to any of embodiments 35-58, wherein each of the plurality of bottom boards has a thickness of at least 0.55 inches.

Embodiment 60. The palleted plurality of roofing shingles according to any of embodiments 35-58, wherein each of the plurality of bottom boards has a thickness of at least 0.57 inches, e.g., at least 0.6 inches.

Embodiment 61. The palleted plurality of roofing shingles according to any of embodiments 35-58, wherein each of the plurality of bottom boards has a thickness in the range of 0.5-0.75 inches, e.g., 0.57-0.75 inches, or 0.6-0.75 inches, or 0.5-0.7 inches, or 0.57-0.7 inches, or 0.6-0.7 inches, or 0.5-0.65 inches, or 0.57-0.65 inches, or 0.6-0.65 inches.

Embodiment 62. The palleted plurality of roofing shingles according to any of embodiments 36-61, wherein the bottom boards are formed of pine wood.

Embodiment 63. The palleted plurality of roofing shingles according to any of embodiments 35-62, wherein the pallet of a palleted plurality of roofing shingles supports an average mass per unit area of at least 1.50 lb/in$^2$, e.g., at least 1.68 lb/in$^2$, or at least 2.02 lb/in$^2$, or at least 2.36 lb/in$^2$, for example, in the range of 1.50-3.03 lb/in$^2$, e.g., in the range of 1.50-2.76 lb/in$^2$, or 1.68-3.03 lb/in$^2$, or 1.68-2.76 lb/in$^2$, or 2.02-3.03 lb/in$^2$, or 2.02-2.76 lb/in$^2$, or 2.35-3.03 lb/in$^2$, or 2.35-2.76 lb/in$^2$.

Embodiment 64. The palleted plurality of roofing shingles according to any of embodiments 35-63, wherein a stack of shingles supported by the pallet is at least 225 shingles in height, e.g., at least 250, at least 300, or even at least 350 shingles in height, for example, in the range of 225-450, or 225-410, 250-450, or 250-410, or 300-450, or 300-410, or 350-450, or 350-410 shingles in height.

Embodiment 65. A double stack of palleted roofing shingles, comprising a top palleted plurality of roofing shingles and a bottom palleted plurality of roofing shingles, each according to any of embodiments 35-64, wherein the pallet of the top palleted plurality of roofing shingles rests on top of shingles of the bottom palleted plurality of roofing shingles.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A roofing shingle having an upper edge, a lower edge, a first end, and a second end, the roofing shingle comprising:

a headlap section extending from the upper edge of the shingle toward the lower edge;

an exposure section below the headlap section and extending from a lower edge of the headlap section to the lower edge of the shingle; and a nailing zone extending across the roofing shingle from the first end to the second end within the headlap section, the roofing shingle being formed of an overlay sheet having a top surface and a bottom surface; and an underlay sheet having a top surface and a bottom surface, each of the overlay sheet and the underlay sheet comprising a substrate, a top asphalt layer extending from a top surface of the substrate and being surfaced with one or more top surfacings, and a bottom asphalt layer extending from a bottom surface of the substrate and being surfaced with one or more bottom surfacings, the overlay sheet overlapping the underlay sheet along an overlap zone extending from the first end to the second end of the roofing shingle in or adjacent the nailing zone, with the top surface of the underlay sheet being affixed to the bottom surface of the overlay sheet in the overlap zone, the top surfacings of any exposed area of the overlayp sheet and the underlay sheet in the exposure zone being roofing granules;

wherein (a) a bottom portion of each of the overlay sheet and the underlay sheet comprising the bottom asphalt layer and the one or more bottom surfacings has a weight of no more than 11 pounds per 100 square feet, or (b) the roofing shingle has at its top surface a small particulate zone defined by a top surfacing of a small particulate material extending from the first end to the second end of the roofing shingle, the small particulate material having a d50 particle size of no more than half a d50 particle size of roofing granules disposed as a top surfacing in a lower adjacent zone to the small particulate zone, the small particulate zone being at least one inch in height as measured in a direction from the upper edge to the lower edge of the shingle, the small particulate zone at least partially overlapping the overlap zone.

2. The roofing shingle according to claim 1, wherein the bottom portion of each of the overlay sheet and the underlay sheet comprising the bottom asphalt layer and the one or more bottom surfacings has a weight of no more than 10.7 pounds per 100 square feet.

3. The roofing shingle according to claim 1, wherein the shingle has at its top surface a small particulate zone defined by a top surfacing of a small particulate material extending from the first end to the second end of the roofing shingle, the small particulate material having a d50 particle size of no more than half a d50 particle size of roofing granules disposed as a top surfacing in a lower adjacent zone to the small particulate zone, the small particulate zone being at least one inch in height as measured in a direction from the upper edge to the lower edge of the shingle, the small particulate zone at least partially overlapping a zone of overlap of the overlay sheet and the underlay sheet.

4. The roofing shingle according to claim 1 wherein the small particulate material is sand.

5. The roofing shingle according to claim 1, wherein the small particulate material has a d50 particle size of no more than ⅓ of a d50 particle size of roofing granules disposed as a top surfacing in a lower adjacent zone to the small particulate zone.

6. The roofing shingle according to claim 1, wherein the small particulate material has a d50 particle size of no more than 350 microns.

7. The roofing shingle according to claim 1, wherein the roofing granules in the lower adjacent zone have a d50 of at least 350 microns.

8. The roofing shingle according to claim 1, wherein a top surface of the surfacing in the small particulate zone is recessed from a top surface of the roofing granules in the lower adjacent zone by at least 400 microns.

9. The roofing shingle according to claim 1, wherein in each of the overlay sheet and the underlay sheet, the top asphalt layer is formed of an elastomer-modified asphalt material.

10. The roofing shingle according to claim 1, wherein the top asphalt layer is formed of SBS-modified asphalt material, wherein a ratio of asphalt to SBS is in the range of 5-26.

11. The roofing shingle according to claim 1, wherein the asphalt component of the asphalt material of the top layer of each of the overlay sheet and underlay sheet has a softening point of no more than 180° F.

12. The roofing shingle according to claim 1, wherein the asphalt component of the asphalt material of the top layer of each of the overlay sheet and underlay sheet has a penetration at 77° F. of at least 35 dmm (deci-millimeters).

13. A stack of roofing shingles according to claim 1 in which the overlap of the small particulate zone and the overlap zone is partial, but not complete, wherein shingles are stacked in facing pairs, wherein the portion of the overlap zone surfaced with roofing granules of a first shingle is disposed against the small particulate zone of a second, facing shingle.

14. A roofing system comprising:

a roof structure;

a first roofing shingle according to claim 1 disposed on the roof structure;

a first mechanical fastener securing the first roofing shingle to the roof structure, wherein the first mechanical fastener is disposed within the nailing zone and passes through the overlay sheet.

15. A method of installing a roofing system according to claim 14, the method comprising:

positioning the first roofing shingle on a roof structure; and driving a first mechanical fastener through the nailing zone of the first roofing shingle and into the roof structure so as to secure the first roofing shingle to the roof structure, wherein the first mechanical fastener passes through the overlay sheet.

16. A roofing system comprising:

a roof structure;

a first roofing shingle and a second roofing shingle, each according to claim 1, disposed on the roof structure, such that the second roofing shingle is disposed on top of the first roofing shingle so as to cover a portion of the headlap section of the first roofing shingle while leaving the exposure section of the first roofing shingle uncovered;

a first mechanical fastener securing the first roofing shingle to the roof structure, wherein the first mechanical fastener is disposed within the nailing zone and passes through the overlay sheet; and a second mechanical fastener securing the second roofing shingle to the roof structure, wherein the second mechanical fastener is disposed within the nailing zone of the second roofing shingle and passes through the overlay sheet of the second roofing shingle.

17. A plurality of roofing shingles according to claim 1, packaged as a stack in a bundle.

18. A palleted plurality of roofing shingles comprising a plurality of roofing shingles according to claim 1, disposed in one or more stacks on a pallet.

19. A palleted plurality of roofing shingles comprising a plurality of roofing shingles disposed in one or more stacks on a pallet, wherein the pallet has a top surface formed of a plurality of top boards, and wherein (a) adjacent boards of the plurality of top boards have a gap of no more than one inch therebetween at the top surfaces thereof; and/or (b) the plurality of top boards take up at least 85% of the occluded area of the top surface of the pallet;

(c) each of the plurality of top boards has a thickness of at least 0.55 inches, and wherein each roofing shingle has an upper edge, a lower edge, a first end, and a second end, each roofing shingle comprising:

a headlap section extending from the upper edge of the shingle toward the lower edge;

an exposure section below the headlap section and extending from a lower edge of the headlap section to the lower edge of the shingle; and a nailing zone extending across the roofing shingle from the first end to the second end within the headlap section, the roofing shingle being formed of an overlay sheet having a top surface and a bottom surface; and an underlay sheet having a top surface and a bottom surface, each of the overlay sheet and the underlay sheet comprising a substrate, a top asphalt layer extending from a top surface of the substrate and being surfaced with one or more top surfacings, and a bottom asphalt layer extending from a bottom surface of the substrate and being surfaced with one or more bottom surfacings, the overlay sheet overlapping the underlay sheet along an overlap zone extending from the first end to the second end of the roofing shingle in or adjacent the nailing zone, with the top surface of the underlay sheet being affixed to the bottom surface of the overlay sheet in the overlap zone, the top surfacings of any exposed area of the overlayp sheet and the underlay sheet in the exposure zone being roofing granules, wherein (a) the bottom portion of each of the overlay sheet and the underlay sheet comprising the bottom asphalt layer and the one or more bottom surfacings has a weight of no more than 11 pounds per 100 square feet, and/or (b) the shingle has at its top surface a small particulate zone defined by a top surfacing of a small particulate material extending from the first end to the second end of the roofing shingle, the small particulate material having a d50 particle size of no more than half a d50 particle size of roofing granules disposed as a top surfacing in a lower adjacent zone to the small particulate zone, the small particulate zone being at least one inch in height as measured in a direction from the upper edge to the lower edge of the shingle, the small particulate zone at least partially overlapping the overlap zone.

20. A double stack of palleted roofing shingles, comprising a top palleted plurality of roofing shingles and a bottom palleted plurality of roofing shingles, each according to claim 18, wherein the pallet of the top palleted plurality of roofing shingles rests on top of shingles of the bottom palleted plurality of roofing shingles.

* * * * *